US010006151B2

(12) United States Patent
Tanaka et al.

(10) Patent No.: US 10,006,151 B2
(45) Date of Patent: Jun. 26, 2018

(54) POLYURETHANE FIBER

(71) Applicant: TORAY OPELONTEX CO., LTD., Tokyo (JP)

(72) Inventors: Toshihiro Tanaka, Shiga (JP); Yasushi Sasaki, Osaka (JP); Koji Hirano, Tokyo (JP); Yasushi Fujita, Tokyo (JP); Fumitake Mori, Tokyo (JP)

(73) Assignee: TORAY OPELONTEX CO., LTD., Osaka (JP)

( * ) Notice: Subject to any disclaimer, the term of this patent is extended or adjusted under 35 U.S.C. 154(b) by 0 days. days.

(21) Appl. No.: 14/760,062

(22) PCT Filed: Jan. 17, 2014

(86) PCT No.: PCT/JP2014/050817

§ 371 (c)(1),
(2) Date: Aug. 17, 2015

(87) PCT Pub. No.: WO2014/112588

PCT Pub. Date: Jul. 24, 2014

(65) Prior Publication Data

US 2016/0002827 A1 Jan. 7, 2016

(30) Foreign Application Priority Data

Jan. 18, 2013 (JP) ..... 2013-007737

(51) Int. Cl.
*D01F 6/20* (2006.01)
*D01F 6/70* (2006.01)
(Continued)

(52) U.S. Cl.
CPC ..... *D01F 6/70* (2013.01); *C11D 3/50* (2013.01); *C11D 3/505* (2013.01); *D06M 13/005* (2013.01); *D06M 2101/38* (2013.01)

(58) Field of Classification Search
CPC ..... D01F 6/70; D06M 13/005; C11D 3/50; C11D 3/505
See application file for complete search history.

(56) References Cited

U.S. PATENT DOCUMENTS 4,637,959 A 1/1987 Ninomiya et al.
6,197,915 B1 * 3/2001 Yamana ..... C08G 18/0895 264/176.1
(Continued)

FOREIGN PATENT DOCUMENTS

JP 5-74128 10/1993
JP 2008-519145 6/2008
(Continued)

OTHER PUBLICATIONS

Document N_English Translation.*
(Continued)

*Primary Examiner* — Michael L Leonard
(74) *Attorney, Agent, or Firm* — Wenderoth, Lind & Ponack, L.L.P.

(57) ABSTRACT

Provided is a fragrance-retaining fiber that, after absorption of a fragrance component, retains the fragrance even though a long period of time has passed. In particular, provided is a fragrance-retaining polyurethane-based fiber having, 48 hours after absorption of a fragrance component, a total fragrance component emission of from 0.1 μg/g·h to 1000 μg/g·h.

2 Claims, 2 Drawing Sheets

(51) Int. Cl.

| | |
|---|---|
| ***D06M 13/00*** | (2006.01) |
| ***C11D 3/50*** | (2006.01) |
| *D06M 101/38* | (2006.01) |

(56) References Cited

U.S. PATENT DOCUMENTS

| | | | | |
|---|---|---|---|---|
| 2006/0099168 | A1 | 5/2006 | Corzani et al. | |
| 2008/0312120 | A1* | 12/2008 | Futterer | C11D 1/342 510/299 |
| 2011/0033409 | A1 | 2/2011 | Tanaka et al. | |
| 2011/0059143 | A1* | 3/2011 | Iavarone | A61K 8/062 424/401 |

FOREIGN PATENT DOCUMENTS

| | | | | |
|---|---|---|---|---|
| JP | 2008196067 | * | 8/2008 | D01F 8/94 |
| JP | 2009191415 | A * | 8/2009 | |
| JP | 2011-162906 | | 8/2011 | |
| JP | 2012-12710 | | 1/2012 | |
| JP | 2012-127025 | | 7/2012 | |
| WO | 99/18926 | | 4/1999 | |
| WO | 01/94521 | | 12/2001 | |
| WO | 2009/101995 | | 8/2009 | |

OTHER PUBLICATIONS

International Preliminary Report of Patentability dated Jul. 21, 2015 in International (PCT) Application No. PCT/JP2014/050817.

International Search Report dated Feb. 25, 2014 in International (PCT) Application No. PCT/JP2014/050817.

Extended European Search Report dated Jul. 22, 2016 in corresponding European Patent Application No. 14740633.4.

* cited by examiner

POLYURETHANE FIBER

TECHNICAL FIELD

The present invention relates to a polyurethane-based fiber excellent in retaining fragrance of a fabric softener for laundry use, a laundry detergent, and/or the like containing a fragrance component.

BACKGROUND ART

Increasingly, many people wish to enjoy scent in daily life. Research and development accordingly have been conducted on fragrances, fragrance formulations and fragrance capsulation techniques, aiming at the following objectives: to allow scent to easily adhere to various types of fiber structures, such as clothing fabrics and bedclothes; to delay the disappearance of the scent by evaporation etc. after the adhesion; and to release strong scent even when such fragrances are used in a small quantity.

It has become a trend to add scent to the laundry in daily life. A typical method therefor is to use fragrance-containing laundry fabric softeners or detergents that allow pleasant scent to be retained on fabrics and clothes even during drying and, of course, to last over a long period of time after the drying. Accordingly, various types of fragrance compositions for such applications have been invented.

A wide variety of fragrance inventions have been created. Such fragrance inventions include fragrances and fragrance formulations, which themselves release scent, as well as products to which the fragrances and the fragrance formulations are added, such as fabric softeners, detergents, fragrance packages for laundry, spray-type fragrance packages used after laundering, etc.

A consumer can benefit from adding scent to the laundry at home or other places. An important benefit is that a consumer can repeatedly add a particular favorite scent to clothes at the time of laundering. Another benefit is that, by changing his/her clothes to different ones having a different fragrance added thereto, the consumer can change the scent they wear to a different one at once. Importantly, such usage of fragrances matches the current trends in favor of light fresh scent. Fragrances with light fresh scent are usually low molecular substances with high volatility. Such highly volatile fragrance components contained in a perfume or an eau de cologne, which is intended to be directly sprayed onto the skin, evaporate quickly (top notes, which form an initial impression of a perfume and dissipate within about several minutes). Making use of top notes over a long period of time is difficult and hence light fresh scent and favorable fresh scent are difficult to be retained. Scent serving the main function of a perfume or an eau de cologne (i.e., middle notes and base notes; the last lingering hint of scent of a perfume) is called heavy scent and is considered to be suitable to create formal impression and atmosphere.

However, attempts to fulfill the above wishes have not been made on fabrics to which scent is to be added. In particular, there has been no technical idea to pursue the improvement of the materials of fiber structures and thereby to increase the fabrics' absorption of a fragrance and to make the scent last longer. In more particular, there has been no technical idea to make light fresh scent last longer.

Similar attempts to the above, however, have been reported and an example thereof involves adding a scent component, a deodorizing component, or the like to fibers or fiber structures at the time of the production thereof (Patent Literature 1 and 2). Another example is a fragrance base material to be used for an aroma freshener, as described in Patent Literature 3.

These examples comprise a particular fragrance as a constituent thereof. Patent Literature 1 and 2 also describe a technique involving adding a fragrance to a fiber material at the time of the production thereof. However, unfortunately, preferences for scents are very personal and are related to individual sense of scents. Manufacturing and stocking a variety of products having different scents that will cover a wide range of personal preferences is very uneconomical. Further, such addition of a particular fragrance to a product at the time of the production may hinder the object of the present invention, in such a manner, for example, that later addition of a favorite fragrance by a consumer through laundering or other methods to a product having a residual fragrance that has been previously added thereto may result in unfavorable scent. Moreover, the previous addition of a particular fragrance to a product cannot fulfill the above-described consumers' wishes to repeatedly change the scent they wear to a different one at once and to wear light fresh scent.

As far as the applicants know, fragrances with clinging properties have been reported, but there has been no report that a fabric with a fragrance-retaining property has been able to be produced.

CITATION LIST

Patent Literature

Patent Literature 1: JP 2012-012710 A
Patent Literature 2: JP 2011-162906 A
Patent Literature 3: JP 2008-519145 T

SUMMARY OF INVENTION

Technical Problem

As described above, a fabric having a satisfactory fragrance-retaining property has not been reported yet.

The present invention has been made in view of problems concerning fiber structures to which scent is to be added. The present invention does not involve addition of a fragrance to a fiber structure at the time of the production thereof, but is aimed at improving fibers that constitute a fabric to which scent is to be added. An object of the present invention is therefore to provide a fragrance-retaining fiber that, after absorption of a fragrance component, retains the fragrance even though a long period of time (for example, about 48 hours) has passed.

Solution to Problem

Surprisingly, the inventors found that clothes, in particular, underwear or intermediate wear, made of polyurethane-based fibers of the present invention can gently release a fragrance component at a lower temperature than that of the skin. The inventors also surprisingly found that use of such a constituent material of clothes as a base material into which a fragrance is to be impregnated, in particular, as a base material into which a highly volatile fragrance is to be absorbed, will have an effect of retaining light fresh scent of a highly volatile fragrance. Based on these findings, the inventors conducted further extensive research and completed the present invention. That is, the present invention relates to the following.

[1] A fragrance-retaining polyurethane-based fiber having, 48 hours after absorption of a fragrance component, a total fragrance component emission of from 0.1 μg/g·h to 1000 μg/g·h.

[2] The fragrance-retaining polyurethane-based fiber according to the above [1], which is a polyurethane fiber and/or a polyurethane urea fiber.

[3] The fragrance-retaining polyurethane-based fiber according to the above [1] or [2], which has a total concentration of urethane and urea groups of from 1.0 mol/kg to 5.0 mol/kg.

[4] The fragrance-retaining polyurethane-based fiber according to any one of the above [1] to [3], wherein the polyurethane-based fiber has a surface area per gram of from 0.02 $m^2$ to 0.2 $m^2$, and/or wherein the polyurethane fiber has a single fiber fineness of from 3 dtex to 300 dtex.

[5] The fragrance-retaining polyurethane-based fiber according to any one of the above [1] to [4], wherein the fragrance component is a compound of from 3 to 15 carbon atoms having a molecular weight of from 50 to 350 and a boiling point of from 20° C. to 200° C.

[6] The fragrance-retaining polyurethane-based fiber according to any one of the above [1] to [5], wherein the absorption of the fragrance component results from washing, in a water bath, with a fabric softener for laundry use and/or a laundry detergent that contains the fragrance component.

[7] The fragrance-retaining polyurethane-based fiber according to any one of the above [1] to [5], wherein the absorption of the fragrance component results from washing, in a dry cleaning solvent, with a fabric softener for laundry use and/or a laundry detergent that contains the fragrance component.

[8] The fragrance-retaining polyurethane-based fiber according to any one of the above [1] to [5], wherein the absorption of the fragrance component results from spraying of a liquid substance that contains the fragrance component.

[9] A fragrance-retaining fabric having the fragrance-retaining polyurethane-based fiber according to any one of the above [1] to [8].

[10] The fragrance-retaining fabric according to the above [9], which has, 48 hours after absorption of a fragrance component, a total fragrance component emission of from 0.01 μg/g·h to 1000 μg/g·h.

[11] The fragrance-retaining fabric according to the above [9] or [10], wherein the amount of the fragrance-retaining polyurethane-based fiber is from 2% by weight to 100% by weight.

[12] A fragrance-retaining polyurethane-based fiber material obtainable by allowing the fragrance-retaining polyurethane-based fiber according to any one of the above [1] to [8] to absorb a fragrance component.

[13] Use of the fragrance-retaining polyurethane-based fiber according to any one of the above [1] to [8], the use comprising allowing the fiber to absorb a fragrance component.

[14] A method for retaining fragrance on a fragrance-retaining polyurethane-based fiber, the method comprising the step of allowing the fragrance-retaining polyurethane-based fiber according to any one of the above [1] to [8] to absorb a fragrance component.

[15] A method for producing a fragrance-retaining polyurethane-based fiber material, the method comprising the step of allowing the fragrance-retaining polyurethane-based fiber according to any one of the above [1] to [8] to absorb a fragrance component.

[16] The method for producing a fragrance-retaining polyurethane-based fiber material according to the above [15], wherein the step of allowing the fiber to absorb a fragrance component is performed twice or more.

Advantageous Effects of Invention

The polyurethane-based fiber of the present invention has an excellent fragrance-retaining property. In particular, the polyurethane-based fiber of the present invention helps the fragrance-retaining function of a fabric softener for laundry use, a laundry detergent, and/or the like containing a fragrance component, and thus pleasant scent on the polyurethane fiber, fabrics containing the polyurethane fiber, and clothes using the fabric lasts over a long period of time after washing and drying. Further, the polyurethane fiber of the present invention shows no or only minor deterioration in such an excellent function and is also markedly excellent in, for example, durability in washing etc.

DESCRIPTION OF EMBODIMENTS

Figure 1:
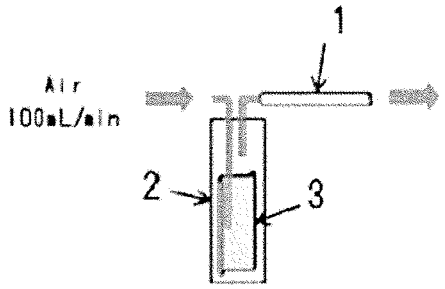
FIG. 1 represents a schematic view showing the measurement of the total emission of a fragrance component in the present invention. The measurement is performed by holding, in a glass container, a sample to which a model fragrance or commercially available fragrance has been added, flowing air through the glass container, and collecting the emitted gas in an adsorption tube.

The fragrance-retaining polyurethane-based fiber of the present invention will be described in detail below.

The fragrance-retaining polyurethane-based fiber of the present invention has, 48 hours after absorption of a fragrance component, a total fragrance component emission of from 0.1 μg/g·h to 1000 μg/g·h.

The term "fragrance-retaining" herein means that added scent lasts for a long period of time. When preferred scent is added, at the time of laundering, to a fabric etc. according to the present invention containing the polyurethane-based fiber of the present invention having a fragrance-retaining property, the preferred scent of the fabric etc. is perceivable, for example, about 24 hours or more after drying, and is preferably perceivable 48 hours or more, more preferably about 72 hours or more, further more preferably about 144 hours or more after drying. The scent from the polyurethane-based fiber or fabric of the present invention is regarded as being easily perceivable when the score evaluated by Six-grade Odor Intensity Measurement (Sensory Analysis 1) described later is, for example, 2.5 or more, preferably 3.0 or more. As another odor indicator, a score evaluated by Nine-grade Pleasant and Annoying Odor Measurement (Sensory Analysis 2) described later is preferably 2 or more, more preferably 3 or more. As a further odor indicator, a score evaluated by Nine-grade Pleasant and Annoying Odor Measurement (Sensory Analysis 3) performed in Functional Retention and Durability Test is preferably 2 or more, more preferably 3 or more.

The fragrance-retaining property can be expressed in terms of, for example, a total emission of a fragrance component measured 48 hours after the step of exposing a fiber or fabric to the fragrance component to allow the fiber or fabric to absorb the fragrance component (for example, a laundering step etc.) and a drying step. The total emission may be determined by, for example, collecting the fragrance component emitted from the fiber or fabric, and analyzing the collected amount by gas chromatography etc. The total emission is usually measured at about 18° C. to 45° C., preferably at about 20° C. to 25° C. More preferably, the measurement is performed at about 22° C. to 24° C. The total emission is preferably from 0.1 μg/g·h to 1000 μg/g·h, more preferably from 0.2 μg/g·h to 500 μg/g·h, most preferably from 0.3 μg/g·h to 200 μg/g·h. The unit "μg/g·h" means a total emission (μg) per hour of a fragrance component that is emitted from 1 g of the fiber of the present invention or the fabric of the present invention having the polyurethane-based fiber. A fabric having a total emission of less than 0.1 μg/g·h is presumed to have an insufficient fragrance-retaining property and an insufficient odor intensity. A fabric having a total emission of more than 1000 μg/g·h may have a too high odor intensity to emit a favorable scent.

The polyurethane-based fiber of the present invention may be produced by polymerization of, for example, a polyol, a diisocyanate compound, a diamine compound, a diol compound, etc., but in the present invention, the polyurethane-based fiber is not limited to a particular type. The synthetic method thereof is also not particularly limited. The polyurethane-based fiber may be, for example, a polyurethane urea fiber produced by polymerization of a polymer diol, a diisocyanate, a low molecular weight diamine, etc., or a polyurethane fiber (a polyurethane urethane fiber) produced by polymerization of a polymer diol, a diisocyanate, a low molecular weight diol, etc. Alternatively, the polyurethane-based fiber may be a polyurethane urea fiber produced using, as a chain extender, a compound having a hydroxy group and an amino group in the molecule. Use of a polyfunctional glycol, polyfunctional isocyanate, etc. that have three or more functional groups is also preferred as long as the effects of the present invention are not impaired. A preferred polymer diol is a polyether diol, a polyester diol, a polycarbonate diol, etc. For the purpose of facilitating efficient addition of a hydrophilic fragrance and a lipophilic fragrance with, in particular, different solubilities to the fiber, a polyether diol is more preferred.

The polyol used in the present invention preferably has a molecular weight ratio of about 0.5 or more and a ratio of weight average molecular weight to number average molecular weight of about 1.8 or more. Use of such a polyol yields a polyurethane-based fiber that is excellent in mechanical physical properties, in the efficiency of absorption of a fragrance added to the fiber, and in the retention of the fragrance-absorbing and emitting function. The polyol preferably has a molecular weight ratio of from about 1.5 to 3 and a ratio of weight average molecular weight to number average molecular weight of from about 2 to 10.

The above molecular weight ratio of a polyol is calculated by the following formula (1).

$$\text{Molecular weight ratio} = 10(0.493 \log \eta + 3.0646) / \text{average molecular weight} \quad (1)$$

η: viscosity at 40° C. (mPa·s)×0.01

(In the formula (1), the average molecular weight is a number average molecular weight.)

The weight average molecular weight and the number average molecular weight are measured by GPC and converted to polystyrene equivalents.

The polyol used in the present invention may be a single type. Alternatively, two or more types of polyols with different molecular weights (a polyol having a relatively higher molecular weight and a polyol having a relatively lower molecular weight) may be blended to give a desired molecular weight within the above range. Preferably, two or more types of polyols with different molecular weights are blended to give a predetermined molecular weight. Blending different types of polyols makes it easier to produce a polyurethane fiber excellent in elongation and tensile properties. The molecular weights of the polyols to be blended are not particularly limited. For example, a polyol having a molecular weight of less than about 600 may be blended with a polyol having a molecular weight of more than about 1600. Alternatively, a polyol having a molecular weight that is about 600 or more but is less than that of another polyol to be blended together may be blended with a polyol having a molecular weight that is more than that of said polyol to be blended together but is not more than about 1600. However, a large difference in the molecular weights of different types of polyols to be blended together will result in the difference in the reactivities of the polyols. Accordingly, the difference in the molecular weights of the different types of polyols to be blended together is preferably about 1000 or less. More preferably, the difference in the molecular weights is about 600 or less.

Examples of the polyether polyol include polyethylene oxides, polyethylene glycols, polyethylene glycol derivatives, polypropylene glycols, polytetramethylene ether glycols (hereinafter abbreviated to PTMGs), a modified PTMG that is a copolymer of tetrahydrofuran (THF) and 3-methyl tetrahydrofuran (hereinafter abbreviated to 3M-PTMG), a modified PTMG that is a copolymer of THF and 2,3-dimethyl THF, a polyol having, on the two bonds of a carbon atom, the side chain as disclosed in JP Patent No. 2615131 etc., a random copolymer in which THF and ethylene oxide and/or propylene oxide are randomly distributed, etc. These polyols may be used in combination or as a copolymer of two or more of them. Preferred are PTMG, 3M-PTMG, or a polyol containing a combination of these two, etc., which can yield a fiber having adequate tenacity and elongation properties as well as adequate recovery force. Another polyol may be added to or copolymerized with PTMG, 3M-PTMG, a polyol containing a combination of these two, or the like to the extent that the properties of the polyols are not deteriorated.

In particular when a hydrophilic fragrance is added to the fiber or fabric during water laundry, preferred is a glycol containing ethylene oxide, etc., and suitable are polyols containing a polyethylene oxide glycol, a polyethylene glycol derivative, or the like. When a lipophilic fragrance is added to and absorbed in the fiber or fabric, suitable polyols are polypropylene glycols, PTMG, 3M-PTMG, etc.

The organic diisocyanate compound used in the present invention may be aromatic, alicyclic, and aliphatic diisocyanate compounds, etc. Examples of the aromatic diisocyanate compounds include diphenylmethane diisocyanate (hereinafter abbreviated to MDI), tolylene diisocyanate, 1,4-diisocyanate benzene, xylylene diisocyanate, 2,6-naphthalene diisocyanate, etc. Examples of alicyclic and aliphatic diisocyanates include methylene bis(cyclohexylisocyanate) (hereinafter referred to as H12MDI), isophorone diisocyanate, methylcyclohexane-2,4-diisocyanate, methylcyclohexane-2,6-diisocyanate, cyclohexane-1,4-diisocyanate, hexahydroxylylene diisocyanate, hexahydrotolylene diisocyanate, octahydro-1,5-naphthalene diisocyanate, etc. These organic diisocyanate compounds may be used alone or in combination of two or more. Among these organic diisocyanate compounds, aromatic diisocyanate compounds etc. are preferred because the resulting fiber will have excellent strength, heat resistance, etc., and more preferred is MDI etc. One or more of other aromatic diisocyanate compounds etc. may be added to MDI.

The reaction equivalent ratio (molar ratio) of the polyol and the organic diisocyanate compound is preferably about 8 or less. This ratio will yield a fiber having excellent tenacity and elongation properties and excellent recovery force as well as excellent processability. The ratio over about 8 may result in, depending on the polymerization process, the formation of a gel, which may affect spinnability. Further, the gel may be spun into a weak fiber, as a result of which the quality of the fiber may be difficult to maintain. In particular, when a polymerization process is performed in a solution, the ratio is preferably about 8 or less, more preferably about 6 or less, and most preferably about 3 or less. However, the ratio less than 1 may tend to result in poor heat resistance and low tenacity and elongation at break, which may affect the quality. The lower limit of the ratio is thus preferably about 1 or more, more preferably about 1.4 or more.

A chain extender, which is a structural unit constituting the polyurethane-based resin, is preferably at least one or more selected from low molecular weight diamines and low molecular weight diols. The chain extender may be a substance having both a hydroxyl group and an amino group in the molecule, such as ethanolamine.

Typical examples of preferred low molecular weight diols include ethylene glycol (hereinafter abbreviated to EG), 1,3-propanediol, 1,4-butanediol, bis(hydroxyethoxy)benzene, bis(hydroxyethylene)terephthalate, 1-methyl-1,2-ethanediol, etc. Particularly preferred are EG, 1,3-propanediol, 1,4-butanediol, etc. Use of these low molecular weight diols will yield a diol-extended polyurethane-based resin having high heat resistance, and such a polyurethane-based resin can yield a polyurethane-based fiber having high strength.

Preferred diamine compounds as a chain extender to produce the polyurethane-based fiber of the present invention will be described below. Use of a diamine compound will yield a fiber having high recovery force, and strong hydrogen bonding forces between the generated urea groups facilitate the capture of hydrophilic fragrances and contribute to the fragrance-retaining property. Examples of the diamine compound include low molecular weight diamine compounds, such as hydrazine, ethylenediamine, 1,2-propanediamine, 1,3-propanediamine, 2-methyl-1,5-pentanediamine, 1,2-diaminobutane, 1,3-diaminobutane, 1-amino-3,3,5-trimethyl-5-aminomethyl cyclohexane, 2,2-dimethyl-1,3-diaminopropane, 1,3-diamino-2,2-dimethylbutane, 2,4-diamino-1-methylcyclohexane, 1,3-pentanediamine, 1,3-cyclohexanediamine, bis(4-aminophenyl)phosphine oxide, hexamethylenediamine, 1,3-cyclohexyldiamine, hexahydro-m-phenylenediamine, 2-methylpentamethylenediamine, bis(4-aminophenyl)phosphine oxide, etc. These diamine compounds may be used alone or in combination of two or more. A low molecular weight diol compound, such as ethylene glycol, may be used together with such a diamine compound to the extent that the properties of the diamine compound are not deteriorated. A preferred diamine compound is a diamine compound of 2 to 5 carbon atoms. Use of ethylenediamine etc. is particularly preferred for producing a fiber excellent in elongation, elastic recovery, etc. A triamine compound (such as diethylenetriamine) etc. that can form crosslinked structures may be used together with these chain extenders to the extent that the triamine compound does not eliminate the effects of the present invention. Preferably, in order to control the molecular weight of the resulting polyurethane, a chain terminator is used at the time of a chain extending reaction. The molar ratio of the chain extender to the chain terminator is preferably about 10 to 20, and with this ratio, the properties of a fiber are stabilized after spinning. More preferably, the molar ratio is about 14 to 18.

The chain terminator used herein is a monoalcohol compound such as n-butanol, a monoamine compound such as dimethylamine, diethylamine, cyclohexylamine, and n-hexylamine, or the like. Preferred is a monoamine compound, and more preferred is diethylamine. The chain terminator is usually mixed with the chain extender before use.

The polymerization process for polymerizing a polyurethane from the polyol, the organic diisocyanate compound and the diamine compound as described above is not particularly limited, and may be melt polymerization, solution polymerization, or other processes, but is more preferably solution polymerization. Solution polymerization has an advantage of less occurrence of an unfavorable substance, such as a gel, in a polyurethane.

In solution polymerization, for example, ingredients, such as the polyol, the organic diisocyanate compound, and the diamine compound can be polymerized in DMAc, DMF, DMSO, NMP, etc., or a solvent containing any of these as a main component to give a polyurethane solution. The reaction method is also not particularly limited. Examples of the reaction method include, the one-shot method, in which all the ingredients are added to and dissolved in a solvent and the solution is heated to an adequate temperature to react; the prepolymer method, in which the polyol and the organic diisocyanate compound are allowed to react without a solvent to prepare a prepolymer, then the prepolymer is dissolved in a solvent, and the chain extending reaction is performed with the diamine compound to synthesize a polyurethane; etc. However, preferred is the prepolymer method.

In the synthesis of the polyurethane, preferably a catalyst such as an amine catalyst and an organometallic catalyst is used either alone or in combination of two or more types. Examples of the amine catalyst include N,N-dimethylcyclohexylamine, N,N-dimethylbenzylamine, triethylamine, N-methyl morpholine, N-ethyl morpholine, N,N,N',N'-tetramethylethylenediamine, N,N,N',N'-tetramethyl-1,3-propanediamine, N,N,N',N'-tetramethylhexanediamine, bis-2-dimethylamino ethyl ether, N,N,N',N'-pentamethyldiethylenetriamine, tetramethylguanidine, triethylenediamine, N,N'-dimethylpiperazine, N-methyl-N'-dimethylaminoethyl-piperazine, N-(2-dimethylaminoethyl) morpholine, 1-methylimidazole, 1,2-dimethylimidazole, N,N-dimethylamino ethanol, N,N,N'-trimethylaminoethyl ethanolamine, N-methyl-N'-(2-hydroxyethyl)piperazine, 2,4,6-tris(dimethylaminomethyl)phenol, N,N-dimethylaminohexanol, and triethanolamine.

Examples of the organometallic catalyst include tin octanoate, dibutyltin dilaurate, and dibutyl lead octanoate.

The concentration of the polyurethane in the obtained polyurethane solution is not particularly limited, but is preferably about 20 to 60% by weight to achieve an adequate molecular weight of the polyurethane, an adequate viscosity of the polyurethane solution, and an adequate elastic properties of the resulting fiber. The concentration of the polyurethane is more preferably about 30 to 50% by weight, and is further more preferably about 35 to 45% by weight.

The concentration of the terminal groups derived from the diamine compound in the polyurethane in the obtained polyurethane solution is preferably about 5 to 50 meq/kg based on the concentration of the polyurethane. More preferably, the concentration of the terminal groups is about 10 to 45 meq/kg. The terminal group concentration of higher than about 50 meq/kg may tend to result in a polymer with a small molecular weight, low tensile properties and low recovery force, and may lead to a fiber unsuitable for clothes etc. The terminal group concentration of lower than about 5 meq/kg may tend to cause several problems: the polymer may have a high molecular weight and part of the polymer forms a gel, which forms a part with low elongation and low strength, resulting in unstable quality; and a high viscosity of the polyurethane solution makes it difficult to increase the polyurethane concentration, resulting in decrease in the productivity.

The concentration of the terminal groups derived from the diamine compound in the polyurethane is measured as follows. DMAc is added to a polyurethane solution so that the polyurethane concentration is about 1.77% by weight. The prepared polyurethane solution is subjected to potentiometric titration by p-toluenesulfonic acid (0.01 N) with an automatic titrator GT-100 produced by Mitsubishi Chemical Analytech, Co., Ltd. to determine the total content of primary amines and secondary amines (A). Next, another polyurethane solution is prepared in the same manner as above. To the prepared polyurethane solution, salicylaldehyde (a 20% solution in isopropyl alcohol) is added and allowed to react with primary amines. This solution is subjected to potentiometric titration by p-toluenesulfonic acid (0.01 N) to determine the content of secondary amines (B). The concentration of the terminal groups derived from the diamine compound is then calculated by the following formula.

$$\text{Effective terminal amine value (meq/kg)}=(A)-(B)$$

A particularly preferred polyurethane-based resin used in the present invention is one that is free from practical problems including problems occurring while passing the production line and has high heat resistance. Such a preferred polyurethane-based resin comprises a product obtained by reaction of a polymer diol and a diisocyanate, and the high-temperature melting point is in the range of about 150 to 300° C. The term "high-temperature melting point" refers to the melting point of so-called hard segment crystals of the polyurethane or polyurethane urea as measured by differential scanning calorimetry (DSC).

In order to achieve an adequate fragrance-retaining property, the total concentration of urethane and urea groups in the polyurethane-based fiber used in the present invention is preferably from about 1.0 mol/kg to about 5.0 mol/kg, more preferably from about 1.0 mol/kg to about 4.5 mol/kg, more preferably from about 1.2 mol/kg to about 4.0 mol/kg. The concentrations of the urethane and urea groups are determined by the following formulas.

$$\text{Urethane group concentration [mol/kg]}=(\text{the amount of polymer diol (mol) in polyurethane fiber})\times 2/(\text{the weight (kg) of polyurethane fiber})$$

$$\text{Urea group concentration [mol/kg]}=(\text{the amount of diisocyanate (mol) in polyurethane fiber}-\text{the amount of polymer diol (mol) in polyurethane fiber})\times 2/(\text{the weight (kg) of polyurethane fiber})$$

In some cases, various types of additives described below are preferably added to the polyurethane used in the present invention.

In particular, for the purpose of enhancing the fragrance-retaining property, the total concentration of the urethane and urea groups contained in the polyurethane-based resin may be adjusted by adding a polyurethane polymer and/or a polyurethane urea polymer that contains an organic diisocyanate and a tertiary nitrogen-containing diol and/or a tertiary nitrogen-containing diamine. To these polymers etc., a polymer having N,N-dialkylsemicarbazide terminal groups may be further added. A compound having a tertiary nitrogen in the backbone and N,N-dialkylsemicarbazide at a terminal exhibits high heat resistance during dyeing and yields a fiber having high tenacity and high elongation as compared with a fiber not containing such a compound, even when the concentration of N,N-dialkylsemicarbazide is low.

Specific examples of a preferred tertiary nitrogen-containing diol include N-methyl-N,N-diethanolamine, N-methyl-N,N-dipropanolamine, N-methyl-N,N-diisopropanolamine, N-butyl-N,N-diethanolamine, N-t-butyl-N,N-diethanolamine, N-octadecane-N,N-diethanolamine, N-benzyl-N,N-diethanolamine, N-t-butyl-N,N-diisopropanolamine, etc. Also usable are piperazine derivatives, such as bis(hydroxyethyl)piperazine and bis(hydroxyisopropyl)piperazine. Among these, particularly preferred are N-t-butyl-N,N-diethanolamine, N-benzyl-N,N-diethanolamine, etc.

Specific examples of a preferred tertiary nitrogen-containing diamine include N-methyl-3,3'-iminobis(propylamine), N-butyl-aminobis-propylamine, N-methyl-aminobis-ethylamine, N-t-butyl-aminobis-propylamine, piperazine-N,N'-bis(3-aminopropyl), piperazine-N,N'-bis(2-aminoethyl), etc. Among these, particularly preferred are N-methyl-3,3'-iminobis(propylamine), piperazine-N,N'-bis(3-aminopropyl), etc.

Specific examples of a preferred organic diisocyanate contained in the polyurethane polymer and/or the polyurethane urea polymer that contains an organic diisocyanate and a tertiary nitrogen-containing diol and/or a tertiary nitrogen-containing diamine include aliphatic diisocyanates such as methylene-bis(4-cyclohexylisocyanate), isophorone diisocyanate, lysine diisocyanate, DDI derived from a dimer acid, etc. Among these, particularly preferred are methylene-bis(4-cyclohexylisocyanate) and isophorone diisocyanate.

A polyurethane or polyurethane urea having a terminal semicarbazide group is also preferred. A substituted hydrazine etc. are preferably used to react with the organic diisocyanate to form a terminal semicarbazide group. Specific examples of a preferred substituted hydrazine include N,N-dimethylhydrazine, N,N-diethylhydrazine, N,N-dipropylhydrazine, N,N-diisopropylhydrazine, N,N-dibutylhydrazine, N,N-diisobutylhydrazine, N,N-dihydroxyethylhydrazine, N,N-dihydroxyisopropylhydrazine, etc. Among these, particularly preferred are N,N-dimethylhydrazine, N,N-dihydroxyethylhydrazine, etc.

Examples of a particularly preferred polyurethane polymer and/or polyurethane urea polymer that contains an organic diisocyanate and a tertiary nitrogen-containing diol and/or a tertiary nitrogen-containing diamine include a polyurethane produced by reaction of N-t-butyl-N,N-diethanolamine and methylene-bis(4-cyclohexylisocyanate), a polyurethane produced by reaction of N-t-butyl-N,N-diethanolamine and methylene-bis(4-cyclohexylisocyanate), followed by reaction of the terminal groups of the resulting polyurethane with N,N-dimethylhydrazine, a polyurea produced by reaction of N-methyl-3,3'-iminobis(propylamine) and methylene-bis(4-cyclohexylisocyanate), etc. The reaction ratio of N-t-butyl-N,N-diethanolamine and methylene-bis(4-cyclohexylisocyanate) is not particularly limited as long as the effects of the present invention are not impaired, but the reaction ratio is, for example, preferably about 1:1.05. At this ratio, the total concentration of urethane and urea groups in an alternating copolymer will be about 5.1 mol/kg.

For the purpose of enhancing the fragrance-retaining property, metallic soaps such as magnesium stearate, and carbonates such as calcium carbonate may be useful as an absorption base for absorbing a fragrance.

For the purpose of enhancing the fragrance-retaining property, the polyurethane-based fiber used in the present invention preferably further comprises cyclodextrin and/or its derivative. For example, any of α-cyclodextrin, β-cyclodextrin γ-cyclodextrin and methylated or hydroxypropylated cyclodextrin can be used.

For the purpose of enhancing the fragrance-retaining property, the polyurethane-based fiber used in the present invention preferably further comprises an inorganic compound. In particular, the polyurethane-based fiber preferably comprises an inorganic compound with a lamellar crystal structure, a lamellar clay mineral, a natural or synthetic zeolite, a natural or synthetic hydrotalcite, or a metallic compound. Examples of the lamellar inorganic compound include lamellar inorganic substances and its derivatives processed with an organic substance. The lamellar inorganic compound may be a solid or fluid. The lamellar inorganic compound may be used alone or in combination of two or more types. Inorganic substances that can be in a form of a lamellar inorganic substance are, for example, silicates, clay minerals, etc. Among them, a preferred lamellar inorganic substance is a laminar clay mineral. Examples of the laminar clay mineral include smectites such as montmorillonite, beidellite, hectorite, saponite, nontronite, and stevensite; vermiculite; bentonite; lamellar sodium silicates such as kanemite, kenyaite, and micanite; etc. These laminar clay minerals may be naturally occurring minerals or products of chemical synthesis. Among the above, preferred is a zeolite. A zeolite has an advantage of having innumerable amorphous or honeycomb-like fine pores with a size of a few microns and thus has an advantage of having a large specific surface area. Due to such a structure, during a water laundry process, water is absorbed in the fine pores, and various types of highly volatile low molecular weight fragrances are also absorbed along with the water. Preferred hydrotalcite compounds are $Mg_6Al_2(OH)_{16}CO_3.4H_2O$, $Mg_{4.5}Al_2(OH)_{13}CO_3.3.5H_2O$, etc. Also preferred is a mixture of $Mg_2Ca(CO_3)_4$ and $Mg_4(CO_3)_4.Mg(OH)_3.4H_2O$, which is a mixture of huntite and hydromagnesite. Preferred metallic compounds are carbonates of a metal selected from Ca, Mg, Al, and Ba, in particular, calcium carbonate, magnesium carbonate, barium carbonate, etc. Preferred oxides are magnesium oxide, aluminum oxide, etc. Preferred hydroxides are calcium hydroxide, magnesium hydroxide, aluminum hydroxide, etc. Preferred composite oxides are $MgO.Al_2O_3$ etc. Among the inorganic compounds, particularly preferred are a hydrotalcite compound $Mg_6Al_2(OH)_{16}CO_3.4H_2O$, a mixture of huntite and hydromagnesite, a composite oxide $MgO.Al_2O_3$. The addition of such an inorganic compound enhances the effects exerted by the fragrance-retaining property.

The above inorganic compounds are added to a spinning solution to be extruded into the polyurethane-based fiber. In order not to disturb the spinning stability, the inorganic compounds preferably have an average particle diameter of about 2 μm or less, and more preferably have an average particle diameter of about 1 μm or less. The term "average particle diameter" herein refers to a diameter that is defined as a particle diameter at which a cumulative weight in the particle size distribution measured by the sieving method reaches 50% by weight. For the purpose of further enhancing the dispersibility of the inorganic compounds in the fiber and stabilizing spinning operation, a surface-treated inorganic compound is also preferably used. Examples of the surface-treated inorganic compound include an inorganic compound of which the surface is treated with, for example, an organic substance such as a fatty acid, a fatty acid ester, a phosphate ester, and a polyol-based organic substance, a silane coupling agent, a titanate coupling agent, water glass, a fatty acid metal salt, a mixture thereof, or the like.

The addition of various types of additives can be performed by any method. Typical examples of such a method include those using a static mixer, a stirrer, a homomixer, a twin screw extruder, etc. When the polyurethane-based fiber is synthesized by solution polymerization, the various types of additives are preferably made into a solution and then added so that the additives are added homogeneously.

In some cases, due to the addition of the various types of additives to the polyurethane solution, the viscosity of the resulting mixture solution becomes unexpectedly high compared with the viscosity of the polyurethane solution before the addition. In order to avoid the increase in the viscosity, an end-capping agent is preferably used either alone or in combination of two or more types. Examples of the end-capping agent include monoamines such as dimethylamine, diisopropylamine, ethylmethylamine, diethylamine, methylpropylamine, isopropylmethylamine, diisopropylamine, butylmethylamine, isobutylmethylamine, isopentylmethylamine, dibutylamine, and diamylamine; monools such as ethanol, propanol, butanol, isopropanol, allyl alcohol, and cyclopentanol; and monoisocyanates such as phenyl isocyanate.

The polyurethane-based fiber used in the present invention may comprise, if necessary, various types of stabilizers, pigments, or the like as long as the effects of the present invention are not impaired. Examples of such stabilizers, pigments, or the like include stabilizers such as an addition polymer of divinylbenzene and p-cresol ("Methacrol" (registered trademark) 2390 produced by DuPont); light resistant agents; antioxidants etc. such as both hindered phenol agents including so-called BHT, and "Sumilizer" GA-80 produced by Sumitomo Chemical Co., Ltd.; benzotriazole and benzophenone agents such as "Tinuvin" produced by Ciba-Geigy K.K.; phosphorus agents such as "Sumilizer" P-16 produced by Sumitomo Chemical Co., Ltd.; various types of hindered amine agents; inorganic pigments such as titanium oxide and carbon black; fluorine resin powders or silicone resin powders; antibacterial agents containing silver, zinc, or a compound thereof; deodorants; lubricants such as silicone and a mineral oil; and various types of antistatic agents such as barium sulfate, cerium oxide, betaine, and a phosphoric acid-based antistatic agent. Such a stabilizer, pigment, or the like may be added to the polyurethane-based fiber or reacted with the polymer. Examples of the antibacterial agents include various types of organic and inorganic antibacterial agents. The antibacterial agents are preferably one or more selected from organic nitrogen-sulfur compounds, quaternary ammonium compounds, phosphoric ester compounds, inorganic compounds containing a metal ion, and the like. Examples of the organic antibacterial agents include organic nitrogen-sulfur compounds; phenol compounds; organic antibacterial agents having an antibacterial metal ion, such as organotin compounds, organocopper compounds, and organosilver compounds; various types of organosilicone quaternary ammonium salts; quaternary ammonium salts of alkyl phosphoric acid esters (such as cetyl dimethyl ammonium chloride); organic antibacterial agents such as benzalkonium chloride, alkyl aryl sulfonate, halo phenol, and phenylmercury (II) acetate; polyphenols; chitosan; etc. Examples of the deodorants include ceramic powders such as zeolite, apatite, activated charcoal, activated alumina, activated silica gel, bentonite, and sepiolite; materials containing silk fibers; metal salts of iron, copper, and the like; and a mixture thereof. Each of these deodorants has an odor-removing function as well as a moisture-absorbing function, and hence one type of these deodorants is sufficient to provide the fabric with both odor-removing function and moisture-absorbing function. In order to further increase durability against, in particular, light, various types of nitrogen oxides, etc., the polyurethane-based fiber may comprise a nitrogen oxide scavenger such as HN-150 produced by Japan Hydrazine Co., Ltd.; a thermal oxidation stabilizer such as "Sumilizer" GA-80 produced by Sumitomo Chemical Co., Ltd.; a light stabilizer such as "Sumisorb" 300#622 produced by Sumitomo Chemical Co., Ltd.; or the like.

When such an inorganic additive is blended in the fiber, the inorganic additive is also preferably surface-treated for the purpose of enhancing dispersibility of the inorganic additive in the fiber and stabilizing spinning operation. Examples of such a surface-treated inorganic additive include an inorganic agent of which the surface is treated with, for example, an organic substance such as a fatty acid, a fatty acid ester, and a polyol-based organic substance; a silane coupling agent, a titanate coupling agent, or a mixture thereof.

In the present invention, the polyurethane-based fiber can be produced by any known spinning process such as wet spinning process, melt spinning process, and dry spinning process, but preferably the polyurethane is produced by dry spinning process or melt spinning process to achieve good productivity and yield elastic fibers with adequate properties. More preferred is dry spinning process to provide fibers having an adequate fragrance-retaining property. The reasons dry spinning process is preferred are as follows: polyurethane fibers produced by dry spinning process have a lipophilic surface and this is advantageous to fragrances, which are mostly lipophilic; and the single fiber fineness and the surface area of the polyurethane fibers are easy to control in dry spinning process.

A treatment agent, such as an oil, may be applied as needed to the polyurethane-based fiber of the present invention after spinning of the fiber. Application of the treatment agent is performed with, for example, an oiling roller etc. A preferred oil is, for example, a silicone oil, a mineral oil, or the like, and use of these oils will yield fibers with an excellent fragrance-retaining property. Before using the polyurethane-based fiber of the present invention, a desired fragrance component is added to and absorbed in the fiber through laundering etc. Accordingly, the polyurethane-based fiber before absorption of the fragrance component is preferably free from another fragrance component so that the preferred scent from the desired fragrance component is not disturbed.

When the polyurethane-based fiber of the present invention is made into a woven or knitted fabric, the surface area of the fiber per gram of the woven or knitted fabric is preferably, for example, from about 0.02 $m^2$ to about 0.2 $m^2$, more preferably from about 0.1 $m^2$ to about 0.2 $m^2$, further more preferably from about 0.12 $m^2$ to about 0.2 $m^2$. The synthetic fiber of the present invention preferably has, for example, a single fiber fineness of from about 3 dtex to about 300 dtex, more preferably from 10 dtex to 150 dtex. The fabric or fiber having such a surface area and/or single fiber fineness is capable of retaining light fresh scent over a longer period of time.

A fiber material or fabric containing the polyurethane-based fiber of the present invention may comprise another type of fibers, and preferably comprises, in particular, another type of synthetic fibers. Said another type of synthetic fibers is not particularly limited as long as the effects of the present invention are not impaired, and examples thereof include polyester fibers, polyamide fibers, polyacryl nitrile fibers, polyvinyl alcohol fibers, polyvinyl chloride fibers, etc. Preferred are polyester fibers etc.

In combination with the polyurethane fiber serving to absorb a fragrance, polyester fibers helps the absorption of a fragrance, especially a lipophilic fragrance, and are thus useful to contribute to the fragrance-retaining property.

Preferred fibers to be combined are, for example, fibers comprising polyethylene terephthalate, polybutylene terephthalate, or ethylene terephthalate as a main repeating unit (preferably accounting for about 90 mol % or more of the total repeating units), or fibers comprising butylene terephthalate as a main repeating unit (preferably accounting for about 90 mol % or more of the total repeating units). Among these, preferred are polyester fibers comprising ethylene terephthalate as a repeating unit accounting for about 90 mol % or more of the total repeating units, and more preferred are polyester fibers comprising ethylene terephthalate as a repeating unit accounting for about 95 mol % or more of the total repeating units. Further preferred are polyester fibers comprising ethylene terephthalate as a repeating unit accounting for about 100 mol % of the total repeating units, i.e., polyethylene terephthalate fibers. Such polyethylene terephthalate fibers have a good texture and luster, and are easy to care for due to its crease-resistance property etc. The polyethylene terephthalate fibers are thus suitable as a fiber material for a fabric having stretchiness. The polyethylene terephthalate fibers are suitable for use in combination with the polyurethane urea fiber that is preferably used in the present invention, and can be formed into a fabric having good characteristics.

In the present invention, the cross section of the polyester fibers may be in any shape such as a circular shape and a modified shape. Preferred are, for example, polyester fibers having moisture-absorbing and quick-drying properties. Examples of the polyester fibers having moisture-absorbing and quick-drying properties include hollow fibers having many minute pores on their walls; and modified cross-section fibers having many grooves, pores, etc. on the surface etc. so that moisture is absorbed through the minute pores, the grooves, the space between the fibers, and the space between the yarns. The polyester fibers having moisture-absorbing and quick-drying properties may be various types of products marketed as moisture-absorbing and quick-drying fibers from synthetic fiber manufacturers. Examples of the polyester fibers having moisture-absorbing and quick-drying properties include "COOLMAX" produced by INVISTA SARL, "CEOα" produced by Toray Industries, Inc., "WELLKEY" produced by Teijin Fibers, Ltd., "DRY FAST" produced by Toyobo Co., Ltd., and "TECHNOFINE" produced Asahi Kasei Corporation.

Fibers provided with moisture-absorbing and quick-drying properties include fibers provided with minute pores or spaces through which moisture is absorbed, and examples of such fibers include, as described above, hollow fibers that are made from a polymer material with low moisture absorbency, such as polyester fibers and acrylic fibers, and that are provided with many minute pores on their walls; and modified cross-section fibers having many grooves, pores, etc. on the surface etc. so that moisture is absorbed through the minute pores, the grooves, the space between the fibers, and the space between the yarns.

Polyester conductive fibers may be used if necessary as synthetic fibers having antistatic properties. Examples of such conductive fibers include composite polyester fibers containing a conductive substance such as carbon black (for example, "Belltron" produced by Kanebo Gohsen, Ltd.), and composite polyester fibers containing white copper iodide or a metal composite oxide (for example, $TiO_2.SnO_2.Sb_2O_2$), but are not limited thereto.

As with the case of the above-described polyurethane, the polyester fibers used in the present invention may contain, if necessary, various types of stabilizers, pigments, or the like as long as the effects of the present invention are not impaired. Examples of such stabilizers, pigments, or the like include stabilizers such as an addition polymer of divinylbenzene and p-cresol ("Methacrol" (registered trademark) 2390 produced by DuPont); a polyurethane produced by reaction of t-butyldiethanolamine and methylene-bis-(4-cyclohexylisocyanate) ("Methacrol" (registered trademark) 2462 produced by DuPont); light resistant agents; antioxidants etc. such as both hindered phenol agents including so-called BHT, and "Sumilizer" GA-80 produced by Sumitomo Chemical Co., Ltd.; benzotriazole and benzophenone agents such as "Tinuvin" produced by Ciba-Geigy K.K.; phosphorus agents such as "Sumilizer" P-16 produced by Sumitomo Chemical Co., Ltd.; various types of hindered amine agents; inorganic pigments such as titanium oxide and carbon black; fluorine resin powders or silicone resin powders; metallic soaps such as magnesium stearate; antibacterial agents containing silver, zinc, or a compound thereof; deodorants; lubricants such as silicone and a mineral oil; and various types of antistatic agents such as barium sulfate, cerium oxide, betaine, and a phosphoric acid-based antistatic agent. Such a stabilizer, pigment, or the like may be added to the polyester fibers or reacted with the polymer. In order to further increase durability against, in particular, light, various types of nitrogen oxides, etc., the polyester fibers may contain a nitrogen oxide scavenger such as HN-150 produced by Japan Hydrazine Co., Ltd.; a thermal oxidation stabilizer such as "Sumilizer" GA-80 produced by Sumitomo Chemical Co., Ltd.; and a light stabilizer such as "Sumisorb" 300#622 produced by Sumitomo Chemical Co., Ltd.; or the like.

Another aspect of the present invention relates to a fabric having the polyurethane-based fiber of the present invention. The fabric may be a mixed-fiber elastic fabric in which another type of yarn such as a polyester yarn and a nylon yarn is mixed, and such a fabric can also exhibit the effects of the present invention.

The fabric of the present invention may be produced, for example, from the polyurethane-based fiber and another synthetic fiber in accordance with a usual fabric making process. The fabric of the present invention particularly preferably comprises the polyurethane-based fiber, and more preferably comprises two or more types of synthetic fibers including the polyurethane-based fiber. The fabric of the present invention may be any of a woven fabric, a knitted fabric, and a nonwoven fabric. For example, the polyurethane fiber may be covered with a synthetic fiber to give a covered fiber, and a fabric may be produced using the covered fiber. Alternatively, the polyurethane fiber may be used as a bare yarn and woven or knitted with a synthetic fiber to form a mixed-fiber woven or knitted fabric.

When a fabric is produced, a clothing pressure that cannot conventionally be achieved without the use of, for example, a yarn of 44 dtex can be achieved by the use of the polyurethane fiber having a fineness of from about 33 dtex to about 22 dtex and having a high urethane concentration and/or a high urea concentration in the present invention. In this case, a thinner lighter fabric that gives a comfortable clothing pressure and a fitted feel can be obtained, and such a thinner and lighter fabric can be made into clothes having improved texture and feel.

The blending ratio of the polyurethane fiber in a mixed-fiber fabric depends on another yarn to be combined with the polyurethane fiber, the knitting stitch, and the weaving pattern, but the blending ratio may be, for example, in the range of from about 2% to about 40%. At this blending ratio, a fabric that has adequate tightness and excellent fitted feel and is thinner and lighter than conventional fabrics can be obtained.

When the fabric of the present invention is a woven fabric, the woven fabric is produced by weaving synthetic fibers alone or in combination with fibers other than synthetic fibers. The synthetic fibers preferably contain two or more types of synthetic fibers including the polyurethane-based fiber. Examples of preferred weaving pattern of the woven fabric made of the polyurethane fiber include three basic weaves such as plain weave, twill weave, and satin weave; derivative weaves such as derivative plain weave, derivative twill weave, and derivative satin weave; special weaves such as honey-comb weave, mock leno weave, and crepe weave; backed weaves such as warp backed weave and weft backed weave; double weaves such as reversible figured weave, hollow weave, and double velvet; multi-ply weaves such as belt weave; warp pile weaves such as warp velvet, towel cloth, seal skin cloth, and velour; weft pile weaves such as velveteen, weft velvet, velvet, and corduroy; and leno weaves such leno, plain gauze, and brocade gauze.

Weaving process is not particularly limited as long as the effects of the present invention are not impaired, but preferably weaving is performed with a shuttle loom (a flying shuttle loom etc.) or a shuttleless loom (a rapier loom, a gripper loom, a water jet loom, an air jet loom, etc.), or the like.

When the fabric of the present invention is a knitted fabric, the knitted fabric is produced by knitting synthetic fibers alone or in combination with fibers other than synthetic fibers. The synthetic fibers preferably contain two or more types of synthetic fibers including the polyurethane-based fiber. The knitted fabric may be a weft knitted fabric or a warp knitted fabric. Examples of preferred knitting stitch of the weft knitted fabric include plain stitch, rib stitch, interlock stitch, purl stitch; tuck stitch, float stitch, half cardigan stitch, lace stitch, and pile stitch. Examples of preferred knitting stitch of the warp knitted fabric include single denbigh stitch, single atlas stitch, double cord stitch, half tricot stitch, fleecy stitch, and jacquard stitch. The knitted fabric may be a single-ply knitted fabric or a multi-ply knitted fabric containing two or more plies.

Knitting process is not particularly limited as long as the effects of the present invention are not impaired, but preferably knitting is performed with a flat knitting machine such as a circular knitting machine, a weft knitting machine, and a Cotton knitting machine; a tricot knitting machine; a Raschel knitting machine; or a Milanese knitting machine; or the like.

The fabric of the present invention is used for, for example, outerwear such as coats, kimonos, suits, uniforms, sweaters, skirts, pants, cardigans, sportswear, dress shirts, and casual wear; hosiery such as tights, stockings, pantyhose, and socks; underwear such as pajamas, underpants, lingerie, foundation garment, and hosiery; bedclothes such as sheets, sheets for a futon, coverings for a futon, blankets, and pillowcases; interior goods such as sofa covers and tablecloths; and accessories such as gloves, neckties, scarves, and shawls. In view of emission of an added fragrance component, the fabric of the present invention is especially suitable for underwear, hosiery, bedclothes, etc.

The fabric of the present invention preferably comprises the synthetic fibers in an amount of, for example, from about 2 to 100% by weight, more preferably in an amount of from about 50 to 100% by weight, further more preferably in an amount of from about 80 to 100% by weight. A fabric comprising the synthetic fibers alone as a fiber component is also preferred because such a fabric exhibits a particularly excellent fragrance-retaining property. Also preferred is a fabric comprising the polyurethane fiber in an amount of from about 1 to 30% by weight, and more preferably in an amount of from about 5 to 20% by weight based on the total amount of the synthetic fibers, and such a fabric also has an excellent fragrance-retaining property.

For taking the advantage of the fabric of the present invention having an excellent fragrance-retaining property, the mass per unit area of the fabric is preferably from 80 to 1000 g/m$^2$, more preferably from 100 to 500 g/m$^2$, further more preferably 100 to 280 g/m$^2$. The fabric also preferably has an elongation of 5% or more in the longitudinal direction and/or the transverse direction.

The fragrance component in the present invention is not particularly limited as long as the effects of the present invention are not impaired. A preferred fragrance component is one having a functional group that interacts with a urea group and/or a urethane group, and the fabric in combination with such a fragrance component can exhibit a high fragrance-retaining property. In view of the emission of the added fragrance from the fabric, also preferred are simple hydrocarbon compounds, simple nitrogen-containing compounds, and simple sulfur-containing compounds.

Known fragrance components etc. can be widely used as a fragrance component in the present invention, and the fragrance component in the present invention may be those described in various documents, such as "Perfume and Flavor Chemicals (Aroma Chemicals)" by Steffen Arctander, Vol. I and II (1994), and "Kaori no Hyakka" edited by Japan Flavor & Fragrance Materials Association, Asakura Publishing Co., Ltd. (1989). Typical examples of fragrances are listed below, but the fragrance component is not limited thereto.

Examples of alcoholic compounds include 3-methyl-1-pentanol, geraniol, cedrol, citronellol, rhodinol, nerol, dihydrolinalool, linalool, tetrahydrolinalool, dimethyloctanol, tetrahydromuguol, muguol, myrcenol, dihydromyrcenol, ocimenol, tetrahydromyrcenol, lavandulol, isodihydrolavandulol, hydroxycitronellol, Nonadyl (6,8-dimethyl-2-nonanol), ethyllinalool, isopulegol, terpineol, dihydroterpineol, terpineol-4, perilla alcohol, 4-thujanol, 3-thujanol, farnesol, nerolidol, α-bisabolol, β-caryophyllene alcohol, santalol, vetiverol, cedrenol, 3-l-menthoxypropane-1,2-diol, Patchouli alcohol, dihydrocarveol, phytol, isophytol, sclareol, carveol, menthol, ethyl alcohol, propyl alcohol, butanol, isoamyl alcohol, 1-heptanol, 2-heptanol, 3-heptanol, 1-octanol, 2-octanol, 3-octanol, 2-ethylhexanol, 1-nonanol, 2-nonanol, isononyl alcohol (3,5,5-trimethyl-1-hexanol), 1-decanol, 1-undecanol, 2-undecanol, 1-dodecanol, prenol (3-methyl-2-buten-1-ol), 2-methyl-3-buten-2-ol, β-pentenol (1-penten-3-ol), leaf alcohol (cis-3-hexenol), trans-2-hexenol, trans-3-hexenol, cis-4-hexenol, 2,4-hexadien-1-ol, matsutakeol (1-octen-3-ol), cis-6-nonenol, cucumber alcohol (2,6-nonadienol), androl (1-nonen-3-ol), Rosalva (9-decenol), 1-undecenol, undecavertol (4-methyl-3-decen-5-ol), oscillol (3,7-dimethyl-7-methoxy-2-octanol), Santalinol (2-methyl-4-(2,2,3-trimethyl-3-cyclopenten-1-yl)-2-buten-1-ol), p,α-dimethylbenzyl alcohol, 2,2,6-trimethylcyclohexyl-3-hexanol, 1,2-pentanediol, benzyl alcohol, anisyl alcohol, β-phenylethyl alcohol, styrallyl alcohol (1-phenyl-1-hydroxyethane), hydratropic alcohol, methyl β-phenylethyl alcohol, α-propylphenylethyl alcohol, vanillyl alcohol, decahydro-β-naphthol, furfuryl alcohol, 3-methyl-1-phenyl-3-pentanol, amyl cinnamic alcohol, cinnamic alcohol, Phenoxanol (3-methyl-5-phenylpentanol), 1,2-pentanediol, 2-ethylhexanol, Dimetol (2,6-dimethylheptanol), 3,6-dimethyl-3-octanol, Kohinool (3,4,5,6,6-pentamethyl-2-heptanol), Brahamanol (methyl trimethyl cyclopentenyl butanol), Bacdanol (2-ethyl-4-(2,2,3-trimethyl-3-cyclopenten-1-yl)-2-buten-1-ol), Sandal (3-methyl-5-(2,2,3-trimethylcyclopent-3-ene-yl)-pentan-2-ol), Sandalol (3-methyl-5-(2,2,3-trimethylcyclopent-3-en-1-yl)pentan-2-ol), cyclohexyl ethyl alcohol, Apo Patchone (p-isopropylcyclohexanol), Floralol (2,4-dimethyl-3-cyclohexene-1-methanol), Patchone (p-tert-butylcyclohexanol), Verdol (o-tert-butylcyclohexanol), Mayol (p-isopropyl cyclohexyl methanol), cyclomethylene citronellol, Ambrinol (2,5,5-trimethyl-octahydro-2-naphthol), Methyl Sandeflor (5' or 6'-methylnorborn-5'-en-2-yl)-2-methylpent-1-en-3-ol), Timberol (2,2,6-trimethylcyclohexyl-3-hexanol), Polysantol (3,3-dimethyl-5-(2,2,3-trimethyl-3-cyclopenten-1-yl)-4-penten-2-ol), hydroxycitronellol, Nonadyl (6,8-dimethyl-2-nonanol), isopulegol, isocyclogeraniol, Myrtenol, Nopol (6,6-dimethylbicyclo[3.1.1]hept-2-en-2-ethanol), pinocarveol, α-fenchylalcohol, borneol, isoborneol, Patchomint (2-(3,3-dimethylbicyclo[2.2.1]hept-2-ylidene)ethanol), Camekol (trimethyl norbornane methanol), dimethyl cyclormol, Santalex T (isocamphyl cyclohexanol), geranyllinalool, cumin alcohol, 2-methoxyphenyl ethyl alcohol, phenoxy ethyl alcohol (1-hydroxy-2-phenoxyethane), α,α-dimethyl phenyl ethyl alcohol, isobutylbenzylcarbinol, p-methylbenzylcarbinol, hydrocinnamic alcohol, Centifol (1,1-dimethyl-3-phenylpropanol-1), Muguet alcohol (2,2-dimethyl-3-phenylpropanol), phenyl hexanol, decahydro-β-naphthol, AR-1 (3,6-dimethyloctan-3-ol), Abitol (hydroabietyl alcohol), α-propylphenylethyl alcohol, p-methyl dimethyl benzyl carbinol, Mugetanol (1-(4-isopropylcyclohexyl)ethanol), Florol (2-isobutyl-4-hydroxy-4-methyltetrahydropyran), propylene glycol, dipropylene glycol, hexylene glycol, etc.

Examples of phenol compounds and phenol ether compounds include anisole, estragole, chavicol, anethole, creosol, carvacrol, p-cresol, p-cresyl methyl ether, β-naphthol methyl ether, β-naphthol ethyl ether, β-naphthol isobutyl ether, Veratrole (1,2-dimethoxybenzene), 1,3-dimethoxybenzene, 1,4-dimethoxybenzene, catechol, resorcinol, guaiacol, Valspice (4-methyl guaiacol), 4-ethyl guaiacol, Orcinyl 3 (3-methoxy-5-methylphenol), thymol, methyl thymol, propenyl guaethol (trans-2-ethoxy-5-(1-propenyl)-phenol), o-ethylphenol, m-ethylphenol, p-ethylphenol, 2-tert-butylphenol, Syringol (2,6-dimethoxyphenol), hydroquinone dimethyl ether, resorcin dimethyl ether, eugenol, isoeugenol, dihydroeugenol, methyl eugenol, methyl isoeugenol, ethyl isoeugenol, benzyl eugenol, benzyl isoeugenol, diosphenol, hinokitiol, Vanitrope (1-ethoxy-2-hydroxy-4-propenylbenzene), shogaol, gingerol, acetyl eugenol, acetyl isoeugenol, safrole, isosafrole, diphenyloxide, vetiver ether (tert-butylhydroquinone dimethyl ether), etc.

Examples of aldehyde compounds include citronellal, citral, 3,7-dimethyl-1-octanal, hydroxycitronellal, methoxycitronellal, perillaldehyde, myrtenal, caryophyllene aldehyde, n-hexanal, 2-methylbutanal, isovaleraldehyde, n-valeraldehyde, acetaldehyde, n-heptanal, n-octanal, n-nonanal, 2-methyloctanal, 3,5,5-trimethylhexanal, 1-decanal, undecanal, dodecanal, 2-methyldecanal, 2-methylundecanal, tridecanal, tetradecanal, 2-pentenal, cis-3-hexenal, trans-2-hexenal, trans-2-heptenal, 4-heptenal, trans-2-octenal, trans-2-nonenal, cis-6-nonenal, Melonal (2,6-dimethyl-5-heptenal), trans-4-decenal, cis-4-decenal, trans-2-decenal, Greenal (2,5,6-trimethyl-4-heptenal), 10-undecenal, trans-2-undecenal, trans-2-dodecenal, Mandarin aldehyde (3-dodecenal), trans-2-tridecenal, Adoxal (2,6,10-trimethyl-9-undecen-1-al), 2,4-hexadienal, 2,4-heptadienal, 2,4-octadienal, 2,4-nonadienal, 2,6-nonadienal, 2,4-decadienal, 2,4-undecadienal, 2,4-dodecadienal, geraldehyde (5,9-dimethyl-4,8-decadienal), trimenal (3,7,9-trimethyl-2,6-decadien-1-al), Oncidal (2,6,10-trimethyl-5,9-undecadienal), Bergamal (α-methylenecitronellal), campholenaldehyde, cyclocitral, isocyclocitral, Safranal (2,6,6-trimethyl-1,3-cyclohexadiene-1-carboxaldehyde), Muget aldehyde (6,10-dimethyl-3-oxa-9-undecenal), geranyl oxyacetaldehyde, Triplal (dimethyl tetrahydrobenzaldehyde), Chrysanthal (3-propylbicyclo[2.2.1]-5-heptene-2-carboxaldehyde), Scentenal (methoxy dicyclopentadiene carboxaldehyde), Dupical (4-tricyclodecylidenebutanal), 4-(4-methyl-3-cyclohexenylidene-1)pentanal, Myrac aldehyde (4(3)-(4-methyl-3-penten-1-yl)-3-cyclohexene-1-carboxaldehyde), Cetonal (trimethyl cyclohexene methylbutanal), Inonal (2-methyl-4-(2,6,6-trimethyl-1(2)-cyclohexenyl)-butenal), Terrestral (4-cyclooctene-1-carboxaldehyde), benzaldehyde, p-tolyl aldehyde, phenylacetaldehyde, Trifernal (3-phenylbutanal), cuminaldehyde, p-methyl phenyl acetaldehyde, p-isopropyl phenyl acetaldehyde, hydratropaldehyde, p-methyl hydratropaldehyde, p-isopropyl hydratropaldehyde, phenylpropionaldehyde, β-methyl hydrocinnamic aldehyde, Jasmorange (2-methyl-3-(4-methylphenyl)-propanal), Bourgeonal (p-tert-butyl hydrocinnamic aldehyde), cyclamen aldehyde (2-methyl-3-(p-isopropylphenyl)-propionaldehyde), Floralozone (p-ethyl-α,α-dimethyl hydrocinnamic aldehyde), Suzaral (p-isobutyl-α-methyl hydrocinnamic aldehyde), cinnamic aldehyde, salicylaldehyde, anisaldehyde, o-methoxybenzaldehyde, o-methoxy cinnamic aldehyde, Canthoxal (2-methyl-3-(p-methoxyphenyl)-propanal), vanillin, ethyl vanillin, methyl vanillin (3,4-dimethoxybenzaldehyde), Heliotropin, Helional (α-methyl-3,4-methylenedioxy hydrocinnamic aldehyde), phenoxy acetaldehyde, p-methylphenoxy acetaldehyde, furfural, 5-methyl furfural, 5-hydroxymethyl-2-furfural, furyl acrolein, Lyral (4(3)-(4-hydroxy-4-methylpentyl)-3-cyclohexene-1-carboxaldehyde), Vernaldehyde (1-methyl-4-(4-methylpentyl)-3-cyclohexenecarboxaldehyde), Homo Myrac aldehyde (1-methyl-4-(4-methyl-3-pentenyl)-3-cyclohexenecarboxaldehyde), Junipal (4(5)-formyl-7,7,9-trimethylbicyclo[4.3.0]-nonene), Vertral (octahydro-4,7-methanoindenecarboxaldehyde), Lilial (p-tert-butyl-α-methyl hydrocinnamic aldehyde), Mefranal (3-methyl-5-phenylvaleraldehyde), Eglantal (4-methyl-2-phenyl-2-pentenal), Cocal (5-methyl-2-phenyl-2-hexenal), α-methyl cinnamic aldehyde, α-butyl cinnamic aldehyde, α-amyl cinnamic aldehyde, α-hexyl cinnamic aldehyde, formyl ethyl tetramethyl tetralin (6-ethyl-7-formyl-1,1,4,4-tetramethyl-1,2,3,4-tetrahydronaphthalene), etc.

Examples of acetal compounds and ketal compounds include Magnolan (2,4-dimethyl-4,4a,5,9b-tetrahydroindeno[1.2d]-1,3-dioxane), Anthoxan (4-isopropyl-5,5-dimethyl-1,3-dioxane), Indoflor (dihydroindenyl-2,4-dioxane), Boisambrene Forte (formaldehyde cyclododecyl ethyl acetal), acetaldehyde diethyl acetal, leaf acetal (acetaldehyde ethyl hexenyl acetal), acetaldehyde ethyl hexyl acetal, citronellyl methyl acetal, Elintaal (acetaldehyde ethyl linalyl acetal), Bonarox (2,4-dioxane-3-methyl-7,10-methanospiro[5.5]undecane), Efetaal (acetaldehyde ethyl phenyl acetal), acetaldehyde ethyl isoeugenyl acetal, Acetal R (acetaldehyde phenylethyl n-propyl acetal), Floropal (acetaldehyde 2-phenyl-2,4-pentanediol acetal), Spiroflor (3-ethyl-2,4-dioxaspiro[5.5]undecen-8-ene), ethyl dimethyl dioxaspiroundecene, Herboxane (2-butyl-4,4,6-trimethyl-1,3-dioxane), Karanal (2-(2,4-dimethylcyclohex-3-en-1-yl)-5-methyl-5-(1-methylpropyl)-1,3-dioxane), hexanal dimethyl acetal, hexanal diethyl acetal, hexanal propylene glycol acetal, Karotin (4,7-dihydro-2-(3-pentanyl)-1,3-dioxepine), 2-hexenal diethyl acetal, cis-3-hexenal diethyl acetal, heptanal dimethyl acetal, heptanal diethyl acetal, heptanal ethylene glycol acetal, 2-hexyl-5-methyl-1,3-dioxolane, 5-methyl-5-propyl-2-(1-methylbutyl)-1,3-dioxane, octanal dimethyl acetal, octanal diethyl acetal, nonanal dimethyl acetal, nonanal diethyl acetal, decanal dimethyl acetal, decanal diethyl acetal, 2-methylundecanal dimethyl acetal, dodecanal dimethyl acetal, citral dimethyl acetal, citral diethyl acetal, citral propylene glycol acetal, citronellal cyclomonoglycol acetal, hydroxycitronellal dimethyl acetal, hydroxycitronellal diethyl acetal, cis-3-hexenal diethyl acetal, benzaldehyde dimethyl acetal, benzaldehyde diethyl acetal, benzaldehyde propylene glycol acetal, benzaldehyde glycerol acetal, phenylacetaldehyde dimethyl acetal, phenylacetaldehyde ethylene glycol acetal, phenylacetaldehyde diisobutyl acetal, phenylacetaldehyde propylene glycol acetal, phenylacetaldehyde 2,3-butylene glycol acetal, phenylacetaldehyde glyceryl acetal, Reseda Body (phenylacetaldehyde-2,4-dihydroxy-2-methylpentane acetal), 3-phenylpropionaldehyde dimethyl acetal, hydratropaldehyde dimethyl acetal, hydratropaldehyde ethylene glycol acetal, Osminal DMA (amyl cinnamic aldehyde dimethyl acetal), Osminal DEA (amyl cinnamic aldehyde diethyl acetal), heliotropin dimethyl acetal, heliotropin diethyl acetal, vanillin propylene glycol acetal, Verdoxan (2,2,5,5-tetramethyl-4-isopropyl-1,3-dioxane), Ambersage (4,7-dihydro-2-isopentyl-2-methyl-1,3-dioxepine), Aceto Ketal (2,5,5-trimethyl-2-phenyl-1,3-dioxane), Jasmonan (2-butyl-4-dioxaspiro[4.4]nonanone), Fraistone (ethyl-2,4-dimethyl-1,3-dioxolane-2-acetate), Fructone (ethyl-2-methyl-1,3-dioxolane-2-acetate), etc.

Examples of ketone compounds include acetyl caryophyllene, carvone, pulegone, piperitenone, piperitone, menthone, camphor, oxocedrane, isolongifolanone, nootkatone, 2-heptanone, 2-pentanone, 3-hexanone, 3-heptanone, 4-heptanone, 2-octanone, 3-octanone, 2-nonanone, 3-nonanone, 2-undecanone, 2-tridecanone, methyl isopropyl ketone, ethyl isoamyl ketone, mesityl oxide, butylidene acetone, methyl heptadienone, methylheptenone, dimethyloctenone, Koavone (4-methylene-3,5,6,6-tetramethyl-2-heptanone), geranyl acetone, farnesyl acetone, acetoin, Butyroin (5-hydroxy-4-octanone), Methyl Lavender Ketone (3-hydroxymethyl-2-nonane), diacetyl, 2,3-pentadione, 2,3-hexadione, 3,4-hexadione, 2,3-heptadione, acetyl isovaleryl, amylcyclopentanone, amylcyclopentenone, 2-cyclopentylcyclopentanone, hexylcyclopentanone, Fleuramone (2-n-heptylcyclopentanone), cis-jasmone, dihydrojasmone, isojasmone, trimethyl pentylcyclopentanone, Sedamon (2-butylidene-3,5,5(3,3,5)-trimethylcyclopentanone), Sandex (3-methyl-5-(2,2,3-trimethyl-3-cyclopentenyl)-3-penten-2-one), Cyclotene, Coronol (3,5-dimethyl-1,2-cyclopentadione), Methyl Corylone (3,4-dimethyl-1,2-cyclopentadione), Verdone (2-tert-butylcyclohexanone), p-tert-butylcyclohexanone, Herbac (3,3-dimethylcyclohexyl methyl ketone), Freskomenthe (2-sec-butylcyclohexanone), Artemone (1-acetyl-3,3-dimethyl-1-cyclohexene), Celery Ketone (3-methyl-5-propyl-2-cyclohexenone), Cryptone (4-isopropyl-2-cyclohexanone), Orivone (p-tert-pentylcyclohexanone), Methyl Cyclocitrone (2,3,5-trimethyl-4-cyclohexenyl-1-methylketone), Nerone (1-(p-menthen-6-yl)-1-propane), Vetival (4-cyclohexyl-4-methyl-2-pentanone), Havanol (2-(1-cyclohexen-1-yl)-cyclohexanone), maltol, ethyl maltol, Oxide Ketone (cis-2-acetonyl-4-methyl-tetrahydropyran), Emoxyfurone (5-ethyl-3-hydroxy-4-methyl-2[5H]-furanone), Homofuronol (2-ethyl-4-hydroxy-5-methyl-3[2H]-furanone and 5-ethyl-4-hydroxy-2-methyl-3[2H]-furanone), Sotolone (3-hydroxy-4,5-dimethyl-2[5H]-furanone), Furaneol (2,5-dimethyl-4-hydroxy-3[2H]-furanone), acetyl dimethylfuran, furfural acetone, 2-acetyl-5-methylfuran, 2-acetylfuran, methyl tetrahydrofuranone, dibenzyl ketone, benzophenone, methyl naphthyl ketone, 4-Damascol (5-phenyl-5-methyl-3-hexanone), Vetikon (4-methyl-4-phenyl-2-pentanone), α-methylanisalacetone, heliotropyl acetone, anisylidene acetone, anisyl acetone, p-methoxyphenyl acetone, raspberry ketone (4-(p-hydroxyphenyl)-2-butanone), Lavandozon (3-methyl-4-phenyl-3-buten-2-one), benzylidene acetone, p-methoxy acetophenone, p-methyl acetophenone, propiophenone, acetophenone, damascenone, damascone, isodamascone, α-Dynascone (1-(5,5-dimethylcyclohexen-1-yl)-4-penten-1-one), Iritone (4-(2,4,6-trimethyl-3-cyclohexen-1-yl)-3-buten-2-one and 4-(3,5,6-trimethyl-3-cyclohexen-1-yl)-3-buten-2-one), ionone, pseudo ionone, methyl ionone, Methyl Iritone (3-methyl-4-(2,4,6-trimethyl-3-cyclohexenyl)-3-buten-2-one), Cyclowood (2,4-di-tert-butylcyclohexanone), irone, allyl ionone, 2,6,6-trimethyl-2-cyclohexene-1,4-dione, Camek DH (2-acetyl-3,3-dimethylnorbornane), Florex (6-ethylideneoctahydro-5,8-methano-2H-1-benzopyran-2-one), Plicatone (4-methyltricyclo[6.2.1.$0^{2,7}$]undecan-5-one), oxocedrane, Vertofix (9-acetyl-2,6,6,8-tetramethyltricyclo[5.3.11.7.$0^{1,5}$]-8-undecene), Verbenone (4,6,6-trimethyl-(1R)-bicyclohept-3-en-2-one), Fenchone, Calone (7-methyl-3,5-dihydro-2H-benzodioxepin-3-one), Trimofix O (2,6,10-trimethyl-1-acetyl-2,5,9-cyclododecatriene), Vitalide (acetyl dimethyl tetrahydrobenzindane), Epitone (7(8)-acetyl-5-isopropyl-2-methylbicyclo[2.2.2]oct-2-ene), Atrinon (4(5)-acetyl-7,7,9(7,7,9)-trimethylbicyclo[4.3.0]-1-nonene), Cashmeran (6,7-dihydro-1,1,2,3,3-pentamethyl-4(5H)-indanone), Muscone (3-methylcyclopentadecanone-1), Muscenone δ (3-methylpentadec-4-enone), Civetone (cycloheptadec-9-en-1-one), Exaltone, (cyclopentadecanone), Musk TM-II (cyclohexadecenone), Phantolid (5-acetyl-1,1,2,3,3,6-hexamethylindane), Celestolide (4-acetyl-6-tert-butyl-1,1-dimethylindane), Traseolide (5-acetyl-3-isopropyl-1,1,2,6-tetramethylindane), Tonalid (6-acetyl-1,1,2,4,4,7-hexamethyltetrahydronaphthalene), Vitalide (acetyl dimethyl tetrahydrobenzindane), Iso E Super (7-acetyl-1,2,3,4,5,6,7,8-octahydro-1,1,6,7-tetramethylnaphthalene), dihydrocarvone, diosphenol, zingerone, etc.

Examples of ether compounds include methyl hexyl ether, decyl methyl ether, decyl vinyl ether, diethylene glycol monomethyl ether, diethylene glycol monoethyl ether, citronellyl ethyl ether, geranyl ethyl ether, α-terpinyl methyl ether, Herbavert (3,3,5-trimethylcyclohexyl ethyl ether), isobornyl methyl ether, tricyclo decenyl methyl ether, Isoproxen (2-ethylidene-6-isopropoxybicyclo[2.2.1]heptane), Juniparome (methoxy dimethyl tricyclo[5.2.1.$0^{2,6}$]decane), cyclododecyl methyl ether, Madrox (1-methyl cyclododecyl methyl ether), Physeol (2-ethoxy-2,6,6-trimethyl-9-methylenebicyclo[3.3.1]-nonane), Cedramber (cedrol methyl ether), methyl benzyl ether, methyl phenyl ethyl ether, ethyl 2-methoxy benzyl ether, allyl phenyl ethyl ether, isoamyl benzyl ether, Anther (isoamyl phenyl ethyl ether), Jacene (2-methyl-2-butenyl phenyl ethyl ether), dibenzyl ether, cyclohexyl phenyl ether, Myroxide (ocimene epoxide), Limonene oxide (p-menth-8-ene-1,2-epoxide), Rhubofix (spiro[1,4-methanonaphthalene-2(1H),2'-oxirane],-3,4,4a,5,8,8a-hexahydro-3',7-dimethyl and spiro[1,4-methanonaphthalene-2(1H),2'-oxirane],-3,4,4a,5,8,8a-hexahydro-3',6-dimethyl), trimethyl cyclododecatriene epoxide, caryophyllene oxide, cedrene epoxide, isolongifolene epoxide, linalool oxide, Citroxide (2,2-dimethyl-5-(1-methyl-1-propenyl)-tetrahydrofuran), Herboxide (5-isopropenyl-2-methyl-2-vinyltetrahydrofuran), Rosefuran (3-methyl-2-(3-methyl-2-butenyl)-furan), Heptavert (2-heptyltetrahydrofuran), Menthofuran, Theaspirane, Oxyvet (2-oxaspiro[4,7]dodecane), Muscogene (3-oxabicyclo[10.3.0]-6-pentadecene), Cyclamber (13-oxabicyclo[10.3.0]pentadecane), Ambroxan (decahydro-3a,6,6,9a-tetramethylnaphtho[2.1-b]furan), Grisalva (3a-ethyldodecahydro-6,6,9a-trimethylnaphtho[2.1-b]furan), 1,8-cineole, 1,4-cineole, Galaxolide (1,3,4,6,7,8-hexahydro-4,6,6,7,8,8-hexamethylcyclopenta-γ-2-benzopyran), rose oxide, nerol oxide, Limetol (2,2,6-trimethyl-6-vinyltetrahydropyran), Gyrane (2-butyl-4,6-dimethyldihydropyran), Doremox (tetrahydro-4-methyl-2-phenyl-2H-pyran), Rhuboflor (9-ethylidene-3-oxatricyclo[6.2.1.$0^{2,7}$]undecane), hexahydro indenopyran, etc.

Examples of acidic compounds include geranic acid, acetic acid, propionic acid, pyruvic acid, butyric acid, isobutyric acid, 2-methylbutyric acid, 2-ethylbutyric acid, valeric acid, isovaleric acid, 2-methylvaleric acid, 3-methylvaleric acid, hexanoic acid, isohexanoic acid, 2-hexanoic acid, 4-pentenoic acid, 2-methyl-2-pentenoic acid, heptanoic acid, 2-methylheptanoic acid, octanoic acid, nonanoic acid, decanoic acid, 2-decenoic acid, undecylenic acid, dodecanoic acid, myristic acid, palmitic acid, stearic acid, anthranilic acid, oleic acid, levulinic acid, lactic acid, benzoic acid, phenylacetic acid, cinnamic acid, 3-phenylpropionic acid, vanillic acid, valine, abietic acid, sorbic acid, etc.

Examples of lactone compounds include Pentalide (cyclopentadecanolide), Habanolide (oxacyclohexadecen-2-one), Ambrettolide, cyclohexadecanolide, 10-oxahexadecanolide, 11-oxahexadecanolide, 12-oxahexadecanolide, ethylene dodecanedioate, γ-butyrolactone, γ-valerolactone, Angelica lactone, γ-hexalactone, γ-heptalactone, γ-octalactone, γ-nonalactone, whiskey lactone (3-methyl-4-octanolide), γ-decalactone, γ-undecalactone, γ-dodecalactone, γ-jasmoiactone, jasmine lactone, cis-jasmone lactone, lactojasmone (4-methyl-4-decanolide), jasmolactone (tetrahydro-6-(3-pentenyl)-2H-pyran-2-one), Menthalactone (3,6-dimethyl-5,6,7,7a-tetrahydro-2(4H)-benzofuranone), n-butylphthalide, propylidenephthalide, butylidenephthalide, δ-hexalactone, δ-octalactone, Trivalon (4,6,6(4,4,6)-trimethyltetrahydropyran-2-one), δ-nonalactone, δ-decalactone, δ-2-decenolactone, δ-undecalactone, δ-dodecalactone, δ-tridecalactone, δ-tetradecalactone, Lactoscaton (decahydro-4,α-hydroxy-2,8,8-trimethylnaphthalene-2-carboxylic acid-δ-lactone), coumarin, dihydrocoumarin, cyclohexyllactone, 6-methylcoumarin, ε-decalactone, ε-dodecalactone, etc.

Examples of ester compounds include ethyl formate, propyl formate, butyl formate, amyl formate, isoamyl formate, hexyl formate, cis-3-hexenyl formate, octyl formate, linalyl formate, citronellyl formate, geranyl formate, neryl formate, rhodinyl formate, terpinyl formate, cedryl formate, caryophyllene formate, Aphermate (α,3,3-trimethylcyclohexanemethyl formate), Oxyoctaline formate, benzyl formate, cinnamyl formate, phenylethyl formate, anisyl formate, eugenyl formate, decahydro-β-naphthyl formate, methyl acetate, ethyl acetate, propyl acetate, isopropyl acetate, butyl acetate, isobutyl acetate, 2-methylbutyl acetate, isoamyl acetate, amyl acetate, prenyl acetate, hexyl acetate, cis-3-hexenyl acetate, trans-2-hexenyl acetate, 2-ethylhexyl acetate, heptyl acetate, octyl acetate, 3-octyl acetate, octenyl acetate, nonyl acetate, decyl acetate, trimethylhexyl acetate, decenyl acetate, nonanediol acetate, dodecyl acetate, dimethyl undecadienyl acetate, diacetyl, diacetin, triacetin, ethylene glycol diacetate, ethylene glycol monobutyl ether acetate, allyl amyl glycolate, ocimenyl acetate, myrcenyl acetate, dihydromyrcenyl acetate, dimethyloctanyl acetate, linalyl acetate, citronellyl acetate, rhodinyl acetate, geranyl acetate, neryl acetate, tetrahydromuguol acetate, ethyllinalyl acetate, lavandulyl acetate, isohydrolavandulyl acetate, nerolidol acetate, carvyl acetate, dihydrocarvyl acetate, dihydrocuminyl acetate, terpinyl acetate, isopulegol acetate, menthyl acetate, citryl acetate, myrtenyl acetate, nopyl acetate, fenchyl acetate, bornyl acetate, isobornyl acetate, cedryl acetate, caryophyllene acetate, santalyl acetate, vetiveryl acetate, guaiac acetate, methyl cyclopentylideneacetate, cyclohexyl acetate, p-isopropyl cyclohexanyl acetate, tert-amyl cyclohexyl acetate, dihydroterpinyl acetate, cyclohexylethyl acetate, Floralate (2,4-dimethyl-3-cyclohexenylmethyl acetate), Rosamusk (α,3,3-trimethylcyclohexanemethyl acetate), Vertenex (p-tert-butylcyclohexyl acetate), Verdox (o-tert-butylcyclohexyl acetate), 1-ethynylcyclohexyl acetate, Dihydroambrate (1-acetoxy-2-sec-butyl-1-vinylcyclohexane), Myraldyl Acetate (4(3)-(4-methyl-3-pentenyl)-3-cyclohexenylmethyl acetate), tricyclodecenyl acetate, tricyclodecyl acetate, benzyl acetate, p-cresyl acetate, phenylethyl acetate, styrallyl acetate, p-methylbenzyl acetate, anisyl acetate, piperonyl acetate, acetyl vanillin, rosephenone, hydratropyl acetate, 2,4-dimethylbenzyl acetate, cinnamyl acetate, phenylpropyl acetate, cuminyl acetate, dimethyl benzyl carbinyl acetate, phenyl glycol diacetate, dimethyl phenyl ethyl carbinyl acetate, phenyl ethyl methyl ethyl carbinyl acetate, Veticol Acetate (4-methyl-4-phenyl-2-pentyl acetate), α-amyl cinnamyl acetate, Jasmalol (trans-decahydro-β-naphthyl acetate), furfuryl acetate, tetrahydrofurfuryl acetate, Jasmal (3-pentyl tetrahydropyranyl acetate), Jasmelia (5-methyl-3-butyltetrahydropyranyl acetate), ethyl acetoacetate, Jessate (ethyl 2-hexylacetoacetate), ethyl benzylacetoacetate, allyl cyclohexylacetate, isopropyl cyclohexenylacetate, ethyl propionate, propyl propionate, allyl propionate, butyl propionate, isobutyl propionate, isoamyl propionate, hexyl propionate, cis-3-hexenyl propionate, trans-2-hexenyl propionate, decenyl propionate, linalyl propionate, citronellyl propionate, rhodinyl propionate, geranyl propionate, neryl propionate, carvyl propionate, terpinyl propionate, menthyl propionate, bornyl propionate, isobornyl propionate, tricyclodecenyl propionate, benzyl propionate, styrallyl propionate, anisyl propionate, phenylethyl propionate, cinnamyl propionate, phenylpropyl propionate, dimethyl benzyl carbinyl propionate, phenoxyethyl propionate, propylene glycol dipropionate, allyl cyclohexane propionate, Labdanax (ethyl 3-hydroxy-3-phenylpropionate), isobutyl furanpropionate, methyl butyrate, ethyl butyrate, propyl butyrate, isopropyl butyrate, allyl butyrate, butyl butyrate, isobutyl butyrate, amyl butyrate, isoamyl butyrate, hexyl butyrate, heptyl butyrate, cis-3-hexenyl butyrate, trans-2-hexenyl butyrate, octyl butyrate, propylene glycol dibutyrate, linalyl butyrate, citronellyl butyrate, rhodinyl butyrate, geranyl butyrate, neryl butyrate, terpinyl butyrate, cyclohexyl butyrate, benzyl butyrate, cinnamyl butyrate, phenylethyl butyrate, dimethyl benzyl carbinyl butyrate, tetrahydrofurfuryl butyrate, santalyl butyrate, methyl isobutyrate, ethyl isobutyrate, propyl isobutyrate, isopropyl isobutyrate, butyl isobutyrate, isobutyl isobutyrate, isoamyl isobutyrate, hexyl isobutyrate, cis-3-hexenyl isobutyrate, 2,4-hexadienyl isobutyrate, Isopentyrate (1,3-dimethyl-3-butenyl isobutyrate), octyl isobutyrate, linalyl isobutyrate, citronellyl isobutyrate, rhodinyl isobutyrate, geranyl isobutyrate, neryl isobutyrate, terpinyl isobutyrate, tricyclodecenyl isobutyrate, benzyl isobutyrate, p-cresyl isobutyrate, cinnamyl isobutyrate, phenylethyl isobutyrate, phenylpropyl isobutyrate, styrallyl isobutyrate, dimethyl carbinyl isobutyrate, dimethyl phenyl ethyl carbinyl isobutyrate, Floranol (phenoxyethyl isobutyrate), decahydro-β-naphthyl isobutyrate, methyl 2-methylbutyrate, ethyl 2-methylbutyrate, 2-methylbutyl 2-methylbutyrate, Cydrane (hexyl 2-methylbutyrate), cis-3-hexenyl 2-methylbutyrate, benzyl 2-methylbutyrate, phenylethyl 2-methylbutyrate, allyl 2-ethylbutyrate, ethyl 3-hydroxybutyrate, methyl valerate, ethyl valerate, butyl valerate, isobutyl valerate, amyl valerate, cis-3-hexenyl valerate, benzyl valerate, phenylethyl valerate, furfuryl valerate, methyl isovalerate, ethyl isovalerate, propyl isovalerate, isopropyl isovalerate, allyl isovalerate, butyl isovalerate, isobutyl isovalerate, isoamyl isovalerate, amyl isovalerate, 2-methylbutyl isovalerate, cis-3-hexenyl isovalerate, hexyl isovalerate, octyl isovalerate, linalyl isovalerate, citronellyl isovalerate, geranyl isovalerate, menthyl isovalerate, terpinyl isovalerate, cyclohexyl isovalerate, benzyl isovalerate, phenylethyl isovalerate, phenylpropyl isovalerate, cinnamyl isovalerate, Manzanate (ethyl 2-methylvalerate), phenyl salicylate, Peranat (2-methylvaleric acid 2-methylpentyl ester), methyl hexanoate, ethyl hexanoate, propyl hexanoate, isopropyl hexanoate, allyl hexanoate, butyl hexanoate, isobutyl hexanoate, amyl hexanoate, isoamyl hexanoate, hexyl hexanoate, cis-3-hexenyl hexanoate, trans-2-hexenyl hexanoate, heptyl hexanoate, linalyl hexanoate, citronellyl hexanoate, geranyl hexanoate, citronellyl hexanoate, benzyl hexanoate, methyl isohexanoate, methyl 2-hexenoate, ethyl trans-2-hexenoate, methyl 3-hexenoate, ethyl 3-hexenoate, methyl 3-hydroxyhexanoate, ethyl 3-hydroxyhexanoate, ethyl 2-ethylhexanoate, Melusat (ethyl 3,5,5-trimethylhexanoate), Berryflor (ethyl 6-acetoxyhexanoate), methyl heptanoate, ethyl heptanoate, propyl heptanoate, allyl heptanoate, octyl heptanoate, methyl octanoate, ethyl octanoate, amyl octanoate, butyl octanoate, propyl octanoate, allyl octanoate, isoamyl octanoate, hexyl octanoate, heptyl octanoate, octyl octanoate, linalyl octanoate, benzyl octanoate, phenylethyl octanoate, p-cresyl octanoate, ethyl 2-octenate, methyl nonanoate, ethyl nonanoate, phenylethyl nonanoate, Beauvertate (methyl 2-nonenoate), methyl 3-nonenoate, methyl decanoate, ethyl decanoate, isopropyl decanoate, butyl decanoate, isoamyl decanoate, ethyl 2-decenoate, ethyl 2,4-decadienoate, propyl 2,4-decadienoate, methyl undecylenate, butyl undecylenate, isoamyl undecylenate, methyl dodecanoate, ethyl dodecanoate, butyl dodecanoate, isoamyl dodecanoate, ethyl myristate, methyl myristate, isopropyl myristate, ethyl palmitate, ethyl stearate, butyl stearate, methyl oleate, ethyl oleate, methyl benzoate, ethyl benzoate, propyl benzoate, isopropyl benzoate, allyl benzoate, isobutyl benzoate, isoamyl benzoate, prenyl benzoate, hexyl benzoate, cis-3-hexenyl benzoate, linalyl benzoate, geranyl benzoate, benzyl benzoate, phenylethyl benzoate, cinnamyl benzoate, methyl anisate, ethyl anisate, methyl o-methoxybenzoate, ethyl o-methoxybenzoate, ethyl tiglate, hexyl tiglate, cis-3-hexenyl tiglate, citronellyl tiglate, geranyl tiglate, benzyl tiglate, phenylethyl tiglate, cinnamyl tiglate, methyl angelate, butyl angelate, isobutyl angelate, isoamyl angelate, prenyl angelate, cis-3-hexenyl angelate, 3-methylpentyl angelate, phenylethyl angelate, ethyl acrylate, phenylethyl methacrylate, ethyl crotonate, isobutyl crotonate, cyclohexyl crotonate, Frutinat (4-methylpentan-2-ol-crotonate), Pyproprunat (2-cyclopentyl-cyclopentyl crotonate), Datilat (1-cyclohexylethyl crotonate), ethyl levulinate, butyl levulinate, isoamyl levulinate, methyl lactate, ethyl lactate, amyl lactate, isobutyl lactate, cis-3-hexenyl lactate, butyl butyryllactate, ethyl pyruvate, methyl geranate, ethyl geranate, methyl cyclogeranate, ethyl cyclogeranate, ethyl methyl phenylglycidate, Fruitate (ethyltricyclo[5.2.1.$0^{2,6}$]decan-2-ylcarboxylate), Givescone (ethyl-2-ethyl-6,6-dimethyl-2-cyclohexene-1-carboxylate and ethyl-2,3,6,6-tetramethyl-2-cyclohexene-carboxylate), Ethyl Safranate (ethyl dehydro cyclogeranate), allyl cyclohexylpropionate, Cyclogalbanate (allyl cyclohexyloxy acetate), Calyxol (ethyl-2-methyl-6-pentyl-4-oxocyclohex-2-enecarboxylate), Tachrysate (methyl-1-methyl-3-cyclohexene carboxylate), Floramat (ethyl-2-tert-butylcyclohexyl carbonate), Jasmacyclat (methyl cyclooctyl carbonate), Mahagonate (1-methyl-4-isopropyl-2-carbomethoxybicyclo[2.2.2]-oct-5-ene), phenylethyl pivalate, methyl jasmonate, Hedione (methyl dihydrojasmonate), Veramoss (methyl-3,6-dimethyl-β-resorcylate), methyl furancarboxylate, ethyl furancarboxylate, propyl furanacrylate, methyl heptinecarboxylate, ethyl heptinecarboxylate, isoamyl heptinecarboxylate, methyl octinecarboxylate, ethyl octinecarboxylate, methyl decynecarboxylate, Glycomel (3-(bicyclo[2.2.1]hept-5-en-2-yl)-3-methyloxirane-carboxylic acid methyl ester), methyl phenylglycidate, ethyl phenylglycidate, Aldehyde C-16 (ethyl 3-methyl-3-phenylglycidate), Aldehyde C-20 (ethyl p-methyl-β-phenylglycidate), ethyl methyl-p-tolylglycidate, ethyl citronellyl oxalate, diethyl succinate, dimethyl succinate, diethyl malonate, diethyl tartrate, diethyl adipate, diethyl sebacate, triethyl citrate, dimethyl phthalate, diethyl phthalate, dibutyl phthalate, methyl phenylacetate, ethyl phenylacetate, isopropyl phenylacetate, butyl phenylacetate, propyl phenylacetate, isobutyl phenylacetate, isoamyl phenylacetate, hexyl phenylacetate, cis-3-hexenyl phenylacetate, citronellyl phenylacetate, rhodinyl phenylacetate, geranyl phenylacetate, menthyl phenylacetate, benzyl phenylacetate, phenylethyl phenylacetate, p-cresyl phenylacetate, eugenyl phenylacetate, isoeugenyl phenylacetate, methyl cinnamate, ethyl cinnamate, propyl cinnamate, isopropyl cinnamate, allyl cinnamate, isobutyl cinnamate, isoamyl cinnamate, linalyl cinnamate, benzyl cinnamate, cinnamyl cinnamate, phenylethyl cinnamate, methyl salicylate, ethyl salicylate, butyl salicylate, isobutyl salicylate, amyl salicylate, isoamyl salicylate, hexyl salicylate, cis-3-hexenyl salicylate, cyclohexyl salicylate, phenyl salicylate, benzyl salicylate, phenylethyl salicylate, Cyclopidene (methyl cyclopentylideneacetate), Abalyn (methyl abietate), Hercolyn (methyl dihydro abietate), p-cresyl salicylate, allyl phenoxyacetate, ethyl phenylpropionate, ethylene brassylate, triacetin, etc.

Examples of nitrogen-containing compounds include methyl anthranilate, ethyl anthranilate, butyl anthranilate, cis-3-hexenyl anthranilate, phenylethyl anthranilate, cinnamyl anthranilate, methyl N-methylanthranilate, Aurantiol (hydroxycitronellal-methylanthranilate Schiff's base), Mevantraal (methylpropylacetaldehyde-methylanthranilate Schiff's base), Jasmentin (α-amyl cinnamic aldehyde-methylanthranilate Schiff's base), Ligantraal (methyl-(3,5-dimethyl-3-cyclohexen-1-yl)methyleneanthranilate), indole, skatole, Clonal (dodecanenitrile), Tangeril (2-tridecenenitrile), Citralva (geranyl nitrile), citronellyl nitrile, Lemonile (3,7-dimethyl-2,6-nonadienenitrile), cuminyl nitrile, Cinnamalva (cinnamyl nitrile), trimethylamine, pyridine, 3-ethylpyridine, 2-acetylpyridine, 3-acetylpyridine, 2-isobutylpyridine, 3-isobutylpyridine, 2-n-pentylpyridine, 5-ethyl-2-methylpyridine, methyl nicotinate, 4-(1,4,8-trimethyl-3,7-nonadienyl)pyridine, quinoline, isoquinoline, p-methylquinoline, tetrahydro-p-methylquinoline, 6-isopropylquinoline, isobutylquinoline, 2-isobutylquinoline, 6-sec-butylquinoline, 8-sec-butylquinoline, 6(p)-tert-2-tert-butylquinoline, N-substituted-p-menthane-3-carboxamide, pyrazine, 2-methylpyrazine, 2,5-dimethylpyrazine, 2,6-dimethylpyrazine, 2,3,5-trimethylpyrazine, 2-ethylpyrazine, 2-ethyl-3-methylpyrazine, 2-ethyl-5-methylpyrazine, 2-ethyl-3,5(3,6)-dimethylpyrazine, 2,3-diethylpyrazine, 2,3-diethyl-5-methylpyrazine, tetramethylpyrazine, 2-methyl-5-vinylpyrazine, methoxypyrazine, 2-methoxy-3-methylpyrazine, 2-methoxy-3-ethylpyrazine, 2-methoxy-3-isopropylpyrazine, 2-isobutyl-3-methoxypyrazine, 2-acetylpyrazine, 2-acetyl-3-ethylpyrazine, methylthio methylpyrazine, Corylone Pyrazine (5-methyl-6,7-dihydrocyclopentapyrazine), 5-methylquinoxaline, cyclohexapyrazine (5,6,7,8-tetrahydroquinoxaline), 1-methylpyrrole, 2-acetylpyrrole, pyrrolidine, Indolene (indole-hydroxycitronellal Schiff's base), 2-methylbenzoxazole, decahydrocyclododecaoxazole, 5-methyl-3-heptanone oxime, Buccoxime (bicyclo[3.2.1]octan-8-one, 1,5-dimethyl-, oxime), Gardamide (N-methyl-N-phenyl-2-methylbutylamide), musk xylol, musk ketone, musk ambrette, musk tibetene, moskene, 2,6-lutidine, piperidine, 2-(1,4,8-trimethyl-3,7-nonadienyl)pyridine, 2-(2-pinen-10-ylmethyl)pyridine, 4-(2-pinen-10-isomethyl)pyridine, piperine, capsaicin, vanillylamide nonanoate, quinine, Perillartine (L-perillaldehyde α-anti-aldoxime), 2-isopropyl-4-methylthiazole, 2-isobutylthiazole, etc.

Examples of sulfur-containing compounds include thiazole, 4-methylthiazole, 4,5-dimethylthiazole, trimethylthiazole, 2-methyl-5-methoxythiazole, 2-isopropyl-4-methylthiazole, 4-methyl-5-vinylthiazole, 2-isobutylthiazole, Sulfurol (4-methyl-5-thiazoleethanol), Sulfuryl Acetate (4-methyl-5-thiazoleethanol acetate), 2-acetylthiazole, 5-acetyl-2,4-dimethylthiazole, benzothiazole, propylmercaptan, hydrogen sulfide, isopropylmercaptan, 2-methyl-3-butanethiol, allylmercaptan, isoamylmercaptan, thiogeraniol, limonene thiol, Sulfox (8-mercaptomenthone), phenyl mercaptan, o-thiocresol, 2-ethylthiophenol, 2-naphthylmercaptan, furfurylmercaptan, 2-methyl-3-furanthiol, dimethyl sulfide, dimethyl disulfide, dimethyl trisulfide, methylpropyl disulfide, methylpropyl trisulfide, propyl disulfide, dipropyl trisulfide, diallyl sulfide, diallyl disulfide, dibutyl sulfide, Methionol (3-(methylthio)-1-propanol), 3-methylthio-1-hexanole, Methional (3-(methylthio)propionaldehyde), mint sulfide, dithiospirofuran, furfurylmethyl sulfide, 2-methyl-5-methylthiofuran, methyl furfuryl disulfide, furfuryl disulfide, thiophene, tetrahydrothiophene, 3-thiophene carboxaldehyde, 5-methyl-2-thiophene carboxaldehyde, tetrahydrothiophen-3-one, trithioacetone, thioglycolic acid, methyl (methylthio)acetate, ethyl (methylthio)acetate, 2-mercaptopropionic acid, pineapple mercaptan (methyl mercaptomethyl propionate), ethyl 3-(methylthio)propionate, ethyl thioacetate, furfuryl thioacetate, furfuryl thiopropionate, methyl thiobutyrate, methyl methane thiosulfonate, allyl isothiocyanate, benzyl isothiocyanate, Thialdine (2,4,6-trimethyl-4,5-dihydro-1,3,5-dithiazone), Oxane (2-methyl-4-propyl-1,3-oxathiane), etc.

Examples of natural fragrances include asafoetida resinoid, ajowan oil, star anise oil, abies oil, amyris oil, ambrette seed oil, ambergris tincture, ylang ylang oil, ylang ylang absolute, iris resinoid, iris absolute, iris oil, winter green oil, elemi oleoresin, elemi resinoid absolute, elemi tincture, oakmoss concrete, oakmoss absolute, oakmoss resin, oakmoss resinoid, ocotea oil, osmanthus absolute, osmanthus concrete, opopanax resinoid, opopanax absolute, opopanax oil, olibanum resinoid, olibanum absolute, olibanum oil, allspice oil, origanum oil, oregano oil, oregano oleoresin, orange oil, orange flower absolute, orange flower concrete, cananga oil, gurjun balsam, gurjun balsam oil, cascarilla bark oil, castoreum absolute, cassie absolute, cassie flower oil, cassia oil, gardenia absolute, carnation absolute, cabreuva oil, chamomile oil, cardamom oil, galbanum oil, galbanum resin, galbanum resinoid, caraway seed oil, carrot seed oil, guaiac wood oil, guaiac resin, guaiac concrete, camphor tree oil, cubeb oil, cumin oil, cumin absolute, cumin oleoresin, clary sage oil, grapefruit oil, clove oil, costus oil, copaiba balsam, copaiba balsam oil, copaiba balsam resin, coriander oil, sassafras oil, sandalwood oil, Spanish broom absolute, shiso oil, citronella oil, jasmine oil, jasmine absolute, jasmine concrete, juniper berry oil, civet absolute, civet tincture, jonquil absolute, agarwood oil, ginger oil, cinnamon oil, cinnamon bark oil, cinnamon leaf oil, cedar tree oil, styrax oil, styrax resinoid, spearmint oil, savory oil, sage oil, cedar oil, cedar leaf oil, geranium oil, celery seed oil, thyme oil, tagetes oil, tarragon oil, tuberose absolute, dill oil, tea tree oil, tree moss absolute, tolu balsam, nutmeg oil, narcissus absolute, neroli oil, violet leaf absolute, pine oil, pine needle oil, basil oil, parsley leaf oil, parsley seed oil, parsley herb oil, patchouli oil, mentha oil, vanilla absolute, honeysuckle absolute, palmarosa oil, valerian oil, bitter orange oil, hyssop oil, hiba oil, hyacinth absolute, fennel oil, fig absolute, petitgrain oil, bucho oil, bay oil, vetiver oil, pennyroyal oil, pepper oil, peppermint absolute, peppermint oil, bergamot oil, Peru balsam, benzoin tincture, benzoin resinoid, bois de rose oil, ho-sho oil, hop oil, hop concrete, hop absolute, marjoram oil, mandarin oil, mandarin orange oil, mimosa concrete, mimosa absolute, mimosa oil, myrrh resinoid, myrrh absolute, myrrh oil, musk absolute, musk tincture, eucalyptus oil, yuzu oil, mugwort oil, lime oil, labdanum oil, labdanum resinoid, lavender oil, lavender absolute, lavandin oil, lavandin absolute, linaloe oil, lemon oil, lemon grass oil, rose oil, rose absolute, rose concrete, rosemary oil, lovage oil, laurel oil, laurel leaf oil, wormwood oil, musk, civet, ambergris, castoreum, musk civet, etc.

Examples of hydrocarbon compounds include ocimene, dihydromyrcene, farnesene, cedrene, α-pinene, β-pinene, limonene, dipentene, camphene, phellandrene, terpinene, 3-carene, terpinolene, bisabolene, β-caryophyllene, cadinene, valencene, thujopsene, guaiene, alloocimene, myrcene, longifolene, Verdoracine (1,3,5-undecatriene), p-cymene, 4-isopropyl-1-methyl-2-propenylbenzene, diphenyl, diphenylmethane, orange terpene, lemon terpene, bergamot terpene, peppermint terpene, spearmint terpene, lime terpene, vetiver terpene, rose wax, jasmine wax, limonene dimer, pentane, hexane, heptane, octane, nonane, decane, undecane, dodecane, tridecane, tetradecane, pentadecane, hexadecane, heptadecane, octadecane, nonadecane, icosane, heneicosane, docosane, tricosane, tetracosane, pentacosane, hexacosane, heptacosane, octacosane, nonacosane, triacontane, etc.

Further, the fragrance component used in the present invention may comprise a solvent for a fragrance, and examples of the solvent for a fragrance include water, alcohols (ethanol, 3-methoxy-3-methylbutanol, triethyl citrate, etc.), acetin (triacetin), MMB acetate (3-methoxy-3-methylbutyl acetate), ethylene glycol dibutyrate, hexylene glycol, dibutyl sebacate, Deltyl Extra (isopropyl myristate), methyl carbitol (diethylene glycol monomethyl ether), carbitol (diethylene glycol monoethyl ether), TEG (triethylene glycol), benzyl benzoate, propylene glycol, diethyl phthalate, tripropylene glycol, Avolin (dimethyl phthalate), Deltyl Prime (isopropyl palmitate), dipropylene glycol DPG-FC (dipropylene glycol), Farnesene, dioctyl adipate, tributyrin (glyceryl tributanoate), Hydrolite-5 (1,2-pentanediol), propylene glycol diacetate, cetyl acetate (hexadecyl acetate), ethyl abietate, Abalyn (methyl abietate), Citroflex A-2 (acetyl triethyl citrate), Citroflex A-4 (tributyl acetyl citrate), Citroflex No. 2 (triethyl citrate), Citroflex No. 4 (tributyl citrate), Durafix (methyl dihydro abietate), MITD (isotridecyl myristate), polylimonene (limonene polymer), propylene glycol, 1,3-butylene glycol, etc.

Among these solvents for a fragrance, those that can be used to adjust the intensity of the odor of a fragrance are ethanol, ethylene glycol dibutyrate, hexylene glycol, methyl carbitol (diethylene glycol monomethyl ether), carbitol (diethylene glycol monoethyl ether), propylene glycol, dipropylene glycol DPG-FC (dipropylene glycol), propylene glycol, 1,3-butylene glycol, etc. The amount of such a solvent contained in a fragrance composition consisting of any of the above fragrances and the solvent is from about 0.1 to 99% by mass, preferably from about 1 to 40% by mass.

A fragrance-containing detergent, fabric softener, fragrance agent, or the like used in the present invention contains the fragrance composition in an amount of usually from about 0.00001 to 50% by mass, preferably in an amount of from about 0.0001 to 30% by mass. The fragrance composition in an amount of less than about 0.00001% by mass may be insufficient to provide a fiber or fabric with scent. The fragrance composition in an amount of more than about 50% by mass may exhibit too strong odor and may reduce working efficiency in laundering.

Preferred fragrance components used in the present invention for adding favorable light fresh scent to a fabric are those having a high volatility, and particularly preferred are those having light fresh scent that gives good impression. Examples of preferred such fragrances include synthetic fragrances such as α-pinene, β-pinene, linalool, phenylethyl alcohol, limonene, benzyl acetate, citronellol, geraniol, terpineol, terpinyl acetate, eugenol, methyl jasmonate, benzyl alcohol, α-ionone, β-ionone, α-methyl ionone, β-methyl ionone, etc. Regarding natural fragrances, a fraction obtained from natural fragrances by vacuum distillation at about 3 mmHg and at about 32 to 100° C. generally corresponds to the fragrance used in the present invention.

Examples of the highly volatile fragrance components include anethole, benzaldehyde, benzyl acetate, benzyl alcohol, benzyl formate, isobornyl acetate, camphene, cis-citral (neral), citronellal, citronellol, citronellyl acetate, p-cumene, decanal, dihydrolinalool, dihydromyrcenol, dimethylphenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, α-methyl ionone, methylnonyl acetaldehyde, methyl phenyl carbinyl acetate, laevomenthyl acetate, menthone, isomenthone, myrcene, myrcenyl acetate, myrcenol, nerol, neryl acetate, nonyl acetate, phenylethyl alcohol, α-pinene, β-pinene, γ-terpinene, α-terpineol, β-terpineol, terpinyl acetate, Vertenex (p-t-butylcyclohexyl acetate), etc. Also preferred are natural oils containing a high proportion of a highly volatile fragrance component. For example, Lavandin contains linalool, linalyl acetate, geraniol, and citronellol as its main components, and is preferred. Lemon oil and orange terpene both contain d-limonene in an amount of, for example, about 95%, and are preferred.

Examples of moderately volatile fragrance components include amyl cinnamic aldehyde, isoamyl salicylate, β-caryophyllene, cedrene, cinnamic alcohol, coumarin, dimethyl benzyl carbinyl acetate, ethyl vanillin, eugenol, isoeugenol, flor acetate, heliotropin, 3-cis-hexenyl salicylate, hexyl salicylate, Lilial (p-t-butyl-α-methyl hydrocinnamic aldehyde), γ-methyl ionone, nerolidol, Patchouli alcohol, phenyl hexanol, β-selinene, trichloromethyl phenyl carbinyl acetate, triethyl citrate, vanillin, veratraldehyde, etc. Cedar terpene is composed primarily of α-cedrene, β-cedrene, and other $C_{15}H_{24}$ sesquiterpenes.

Examples of slightly volatile fragrance components include benzophenone, benzyl salicylate, ethylene brassylate, Galaxolide (1,3,4,6,7,8-hexahydro-4,6,6,7,8,8-hexamethylcyclopenta-γ-2-benzopyran), hexyl cinnamic aldehyde, Lyral (4-(4-hydroxy-4-methylpentyl)-3-cyclohexene-10-carboxaldehyde), methyl cedrylone, methyl dihydrojasmonate, methyl β-naphthyl ketone, musk indanone, musk ketone, musk tibetene, phenylethyl phenyl acetate, etc.

Preferred fragrance components used in the present invention for adding favorable light fresh scent to a fabric are compounds having a boiling point of about 250° C. or lower, more preferably compounds having a boiling point of from about 20° C. to about 200° C. Also preferred are compounds having from about 3 to about 15 carbon atoms, and compounds having a molecular weight of from about 50 to about 350. Particularly preferred are fragrance components having from 3 to 5 carbon atoms, having a molecular weight of from 50 to 350 and having a boiling point of from 20° C. to 200° C. Such fragrance components are not particularly limited as long as the effects of the present invention are not impaired, and example thereof include 1,8-cineole, 1,4-cineole, α-ionone, β-ionone, Lilial, etc. In terms of the boiling points, molecular weights, etc. of the fragrance components, reference may be made to known documents, for example, "Perfume and Flavor Chemicals (Aroma Chemicals)", supra.

The above fabric softener for laundry use, laundry detergent, etc. are not particularly limited as long as they contain a fragrance component, and the fabric softener, detergent, etc. may be those originally containing a fragrance component, or those to which a fragrance component such as a commercially available fragrance agent has been added. The method for adding a fragrance component to a fabric softener for laundry use, a laundry detergent, and/or the like is not particularly limited, and for example, a fragrance component may be mixed with a fabric softener for laundry use, a laundry detergent, and/or the like prior to washing.

The fabric softener for laundry use used in the present invention may be various types of fabric softeners such as a fabric softener composition for laundering clothes, and is not particularly limited. Examples of the fabric softener that can be used in the present invention include wax emulsions, zwitterionic surfactant-based fabric softeners, cationic surfactant-based fabric softeners, nonionic surfactant-based fabric softeners, oil-and-fat-based fabric softeners, polyalcohol-based fabric softeners, etc. The fabric softener for laundry use used in the present invention may be a fabric softener for water laundry or a fabric softener for solvent laundry.

Particularly preferred are fabric softeners containing an amino group-containing silicone, an oxyalkylene group-containing silicone, and a surfactant. Examples of the surfactant include anionic surfactants, such as carboxylate-based anionic surfactants, sulfonate-based anionic surfactants, sulfuric acid ester salt-based anionic surfactants, and phosphoric acid ester salt-based anionic surfactants (in particular, alkyl phosphoric acid esters); polyalcohol monofatty acid esters, such as sorbitan fatty acid esters, diethylene glycol monostearate, diethylene glycol monooleate, glyceryl monostearate, glyceryl monooleate, and propylene glycol monostearate; nonionic surfactants, such as N-(3-oleoyloxy-2-hydroxypropyl)diethanolamine, polyoxyethylene hydrogenated castor oil, polyoxyethylene sorbitol beeswax, polyoxyethylene sorbitan sesquistearate, polyoxyethylene monooleate, polyoxyethylene sorbitan sesquistearate, polyoxyethylene glyceryl monooleate, polyoxyethylene monostearate, polyoxyethylene monolaurate, polyoxyethylene monooleate, polyoxyethylene cetyl ether, and polyoxyethylene lauryl ether; cationic surfactants, such as quaternary ammonium salts, amine salts, and amines; zwitterionic surfactants, such as aliphatic derivatives of a secondary or tertiary amine that contain a carboxylate, a sulfonate or a sulfate, and aliphatic derivatives of a heterocyclic secondary or tertiary amine; etc. Nonionic surfactants are the most preferred to achieve an adequate fragrance-retaining property.

The detergent used in the present invention may be various types of detergents such as a detergent composition for clothes, and is not particularly limited. For example, a usual clothes detergent composition having a powder or liquid formulation can be used. Preferred are powder or liquid detergent compositions containing a nonionic surfactant. The detergent used in the present invention may be a detergent for water laundry or a detergent for solvent laundry.

The present invention also includes use of a polyurethane-based fiber of the present invention for retention of the fragrance component. Allowing the polyurethane-based fiber of the present invention to absorb the fragrance component contained in the fabric softener for laundry use, laundry detergent, and/or the like leads to effective retention of the favorable scent of the fragrance component, as a result of which the polyurethane-based fiber exhibits a fragrance-retaining property and retains the favorable scent over a long period of time.

The present invention also includes a method for retaining fragrance on a fabric, the method comprising the step of allowing the polyurethane-based fiber of the present invention to absorb a fragrance component. The step of allowing the fiber to absorb a fragrance component is preferably performed by laundering. The laundering may be either washing in a water bath (water laundry) or washing in a dry cleaning solvent (solvent laundry), but preferred is water laundry, which is regularly performed at home. In another embodiment, the step of allowing the fiber to absorb a fragrance component is performed by, for example, spraying a liquid substance containing a fragrance component onto the fiber. The present invention also includes a fiber material obtainable by allowing the polyurethane-based fiber of the present invention to absorb a fragrance component. Such a fiber material provided as a product of the present invention is preferably one obtained by performing the fragrance absorption step twice or more for an excellent fragrance-retaining property.

The laundry process is not particularly limited as long as the effects of the present invention are not impaired, and the laundry process may have, for example, a washing step, a rinsing step, and a drying step. The washing step and/or the rinsing step may be performed more than once as needed. The drying may be performed by, for example, natural drying such as hang drying, or by drying with a clothes dryer. The water laundry process is not particularly limited as long as a fabric softener for laundry use and/or a laundry detergent that contains a fragrance component is used, and the water laundry process may be machine washing or hand washing. The solvent laundry is a washing method using a solvent other than water. The solvent is not particularly limited as long as the effects of the present invention are not impaired, and examples of the solvent include petroleum solvents such as paraffin, naphthene, and aromatic hydrocarbons; and synthetic solvents such as tetrachloroethylene, and dichloropentafluoropropane. The laundry conditions such as the temperature and duration of each step vary with the type of fabric etc. and may be adjusted as appropriate.

When the absorption of a fragrance component by the polyurethane-based fiber of the present invention is achieved by laundering, the fragrance component may be contained in either a detergent or a fabric softener for laundry use, or contained in both. Alternatively, a fragrance agent containing the fragrance component may be used together with a fabric softener for laundry use and/or a laundry detergent. Particularly preferably, the absorption of a fragrance component by the polyurethane-based fiber is achieved at the final rinsing step of laundering. In this case, rinsing water etc. containing the above-described fabric softener for laundry use is preferably used. The above-described fabric softener for laundry use and/or laundry detergent preferably contains a fragrance component in an amount of from about 0.0001 to about 1% by weight, more preferably in an amount of from about 0.01 to about 0.5% by weight. The duration of laundering is not particularly limited and may be, for example, several minutes to about 48 hours including a drying step, and is preferably several minutes to about 24 hours including a drying step.

The fabric to be subjected to laundering in the present invention and clothes containing the fabric are not particularly limited as long as the fabric and clothes can be laundered. In the laundering process of the present invention, the fibers, in which ionic functional groups or ion exchange functional groups or additives containing these functional groups are contained, should not be adversely affected. That is, a detergent composition should not reduce the ionic function or the ion exchange function (capability of absorbing ionic fragrances). In order to avoid the reduction, the detergent composition for clothes preferably contains a nonionic surfactant having an HLB of from 10 to 17. Examples of the nonionic surfactant include an ethylene oxide adduct or propylene oxide adduct of a linear or branched alcohol ethoxylate, an ethylene oxide/propylene oxide adduct (a block polymer, a random polymer), etc.

Specific examples of the nonionic surfactant include polyoxyalkylene alkyl (or alkenyl) ethers obtained by adding an average of 3 to 30 mol, preferably 7 to 20 mol, of an alkylene oxide of 2 to 4 carbon atoms to an aliphatic alcohol of 6 to 22 carbon atoms, preferably 8 to 18 carbon atoms. Among these, particularly preferred are polyoxyethylene alkyl (or alkenyl) ethers, polyoxyethylene polyoxypropylene alkyl (or allenyne) ethers, and polyoxyethylene alkyl (or alkenyl) phenyl ethers. Other specific examples thereof include a compound obtained by inserting an alkylene oxide into the ester bond of a long chain fatty acid alkyl ester, a polyoxyethylene sorbitol fatty acid ester, a glycerol fatty acid ester, and a nonionic sugar ester surfactant selected from esters of a fatty acid of 6 to 18 carbon atoms with a monosaccharide of 5 or 6 carbon atoms or a monoalkyl ether of the monosaccharide, etc.

Other preferred nonionic surfactants that can be used are those containing an ethylene oxide group or a propylene oxide group. Examples thereof include a nonionic surfactant in which the number of moles (n) of ethylene oxide added is 3 to 20 and in which the amount of unreacted alcohol (n=0) is 10% by mass or less, a compound obtained by adding an average of 5 to 15 mol of ethylene oxide to a secondary alcohol of 10 to 16 carbon atoms, and a nonionic surfactant obtained by adding an average of 5 to 15 mol of ethylene oxide to a primary alcohol having a branched alkyl or alkenyl group having a total of 8 to 22 carbon atoms and having a shortest branched chain length of 5 carbon atoms or less.

Further examples of the nonionic surfactant that can be used include nonionic surfactants having an HLB of 10 to 16 and having a fatty acid ester backbone or hydrogenated castor oil backbone. These surfactants are compounds obtained by adding hydrophilic groups to the backbone, and are produced by using, for example, sorbitan fatty acid ester, polyoxyethylene sorbitan fatty acid ester, monostearate polyethylene glycol, isostearate polyethylene glycol, isostearate polyoxyethylene glyceryl, triisostearate polyoxyethylene glyceryl, trioleate polyoxyethylene glyceryl, polyoxyethylene hydrogenated castor oil, polyoxyethylene castor oil, lauric acid polyoxyethylene hydrogenated castor oil, isostearic acid polyoxyethylene hydrogenated castor oil, etc.

Nonionic surfactants having an HLB outside the range of 10 to 17 are not preferred in the methods of the present invention because the washing effect against various types of dirt will be low. The amount of the HL nonionic surfactant contained in the detergent composition is preferably 10 to 60% by mass based on the total amount of the detergent composition. The detergent composition for clothes used in the methods of the present invention may contain as appropriate, in addition to any given type of the above nonionic surfactants having an HLB of 10 to 17, an ingredient that is usually contained in detergent raw materials, and examples of such an ingredient include porous inorganic oxide powders such as amorphous silica, clay compounds such as montmorillonite and hectorite, aluminosilicates, inorganic alkali builders such as sodium carbonate, fluorescence agents, enzymes, beef tallow soaps, grinding aids, fluidity improving agents, etc.

The residues of the detergent ingredients and fabric softener ingredients remaining after laundering may hardly affect the fragrance-retaining property, but such residues of the detergent ingredients are preferably removed as much as possible by powerful rinsing, spin drying, or other methods to allow the effective fragrance-retaining property to be effectively exhibited.

When a liquid substance containing a fragrance component is sprayed onto the polyurethane-based fiber of the present invention to allow the fiber to absorb the fragrance component, the liquid substance is not particularly limited as long as the effects of the present invention are not impaired. The liquid substance may be a liquid containing the above-described solvent for a fragrance, and is preferably a liquid containing a fragrance component in an amount of from about 0.0001 to 1% by weight, and is more preferably a liquid containing a fragrance component in an amount of from about 0.01 to about 0.5% by weight.

EXAMPLES

The present invention will be described in more detail below with reference to Examples and Comparative Examples, but the present invention is not limited thereto. The symbol "%" in the following Examples and Comparative Examples means "% by weight".

In the Examples, fragrances were added as follows.

Addition of Model Fragrance

As a model fragrance, a solution was prepared by dissolving cineole, α-ionone and Lilial, each in an amount of 0.15 g, in 100 mL of ethanol. Twenty milliliters of this solution was diluted with 980 mL of water and used as a second rinsing water. The absolute quantities of the fragrance components in 90 mL of the second rinsing water were set as follows.

| | |
|---|---|
| Cineole | 2700 μg |
| α-ionone | 2700 μg |
| Lilial | 2700 μg |
| Ethanol | 1.8 g |
| Pure water | q.s. to 90 mL |

From each of the fabrics produced in Examples and Comparative Examples described below, a 3.00±0.10 g sample was cut out (for example, a 3.00 g sample cut out from a fabric with a mass per unit area of 150 g/m$^2$ will have a 10 cm×20 cm rectangular shape). As a washing procedure, the 3.00 g sample to which the model fragrance was to be added was placed in a 100 mL media bottle, to this, 0.12 mL of JAFET Standard Detergent and 90 mL of pure water were added, and the media bottle was shaken on a shaker at an initial temperature of 40° C. for 5 minutes. After that, as a spin drying procedure, centrifugation was performed at 3000 rpm for 2 minutes. Next, as a first rinsing procedure, the spin-dried sample was placed in a 100 mL media bottle with 90 mL of pure water, the media bottle was shaken on a shaker at an initial temperature of 40° C. for 2 minutes, and spin drying was performed as described above. As a second rinsing procedure, the sample after the first rinsing procedure was placed in a 100 mL media bottle with 90 mL of the second rinsing water containing the model fragrance, the media bottle was shaken on a shaker at an initial temperature of 23° C. for 2 minutes, and spin drying was performed as described above. When washing needs to be repeated multiple times to evaluate functional retention in Functional Retention and Durability Test, the overall washing process was repeated in the same manner as above except that the spin drying step in the first rinsing procedure was not performed and that the first rinsing procedure was performed only once for each washing. After the washing process was finished, the sample to which the model fragrance was added was hang dried at a relative humidity of 65% and at room temperature for 24 hours.

Addition of Commercially Available Fragrance

In an automatic washing machine (AW-80VC (WL) produced by Toshiba Corporation) were placed a detergent, ten commercially available cotton towels (cotton 100%) (weight: 1000±100 g), and two shirt-shaped sewn products having a size corresponding to size LL (for males) as samples to which a commercially available fragrance was to be added (the total weight of the shirt-shaped sewn products was adjusted to 400±40 g by cutting and removing, as needed, part of the bodies of the shirt-shaped sewn products; this test procedure corresponds to laundering shirts using a fragrance-containing fabric softener). Water level was set at 12 L, and a fabric softener was poured into the fabric softener dispenser. Automatic Course including successive steps of washing (for 6 minutes), two cycles of rinsing, and spin drying (for 6 minutes) was selected and the washing process was started. The water used for the washing was tap water. After the overall washing process was finished, the sample to which the commercially available fragrance was added was hang dried at a relative humidity of 65% and at room temperature for 24 hours.

Detergent:

JAFET Standard Detergent (non-fragrance) 16 mL

Lenor Happiness Aroma Jewel Ruby (a fragrance commercially available from P & G Company) 5 g Fabric softener: not used In the following Examples, sensory analyses were performed as follows.

Sensory Analysis 1: Six-Grade Odor Intensity Measurement

Four odor judges evaluated the odors from samples having fragrances added thereto, based on the following six-grade odor-intensity criteria. The scores were reported in 0.5 point increments, and the scores from each judge were averaged. This sensory analysis evaluated only the retained fragrance odors, and thus the odor intensities reported herein are those of the retained fragrance odors alone. The evaluation was performed three times: 24 hours, 48 hours and 72 hours after the drying.

Odor Intensity

0: No odor
1: Barely perceivable odor
2: Faint but identifiable odor
3: Easily perceivable odor
4: Strong odor
5: Very strong odor Sensory Analysis 2: Nine-Grade Pleasant and Annoying Odor Measurement Four odor judges evaluated the odors from samples having fragrances added thereto, based on the following nine-grade pleasantness and annoyance criteria. The scores were reported in 0.5 point increments, and the scores from each judge were averaged. The odor judges also evaluated the characteristics of the odors. The purpose of this sensory analysis was to evaluate the overall odors from the samples having fragrances added thereto. The overall odors include the retained fragrance odors and the odors from the fabrics themselves. The evaluation was performed 48 hours after the drying.

Pleasantness and Annoyance

+4: Extremely pleasant
+3: Very pleasant
+2: Pleasant
+1: A little pleasant
0: Neither pleasant nor annoying
−1: A little annoying
−2: Annoying
−3: Very annoying
−4: Extremely annoying Sensory Analysis 3: Functional Retention and Durability Test Two shirt-shaped sewn products having a size corresponding to size LL (for males) (the total weight of the shirt-shaped sewn products was adjusted to 400±40 g by cutting and removing, as needed, part of the bodies of the shirt-shaped sewn products) were used as samples to which fragrances were to be added. The model fragrance or commercially available fragrance was added in the same manner described in the prior sections entitled Addition of Model Fragrance and Addition of Commerically Available Fragrance. The samples were subjected to the washing process 50 times, and hang dried at a relative humidity of 65% and at room temperature for hours. Sensory Analysis 2 was then performed on the samples.

Measurement of Total Emission of Fragrance Components

In the following Examples, the measurement of the total emission of fragrance components was performed as follows.

Instrumental analysis was performed by gas chromatography-mass spectrometry (hereinafter abbreviated to GC/MS).

In particular, from a fabric left for 48 hours after addition of a fragrance and drying, a 10- to 20-cm square sample was cut out and the weight was adjusted to 3.00±0.10 g by weighing the sample to an accuracy of 0.01 g. The sample was held in a glass container (impinger). Air (AirzeroA) is flowed through the glass container at 100 mL/min at room temperature (23° C.±3° C.) or 40° C. for 1 hour. The emitted gas was collected in an adsorption tube (adsorbent: Tenax-GR). FIG. 1 shows the schematic view of the device used for the collection. As shown in FIG. 1, Sample 3 to which a model fragrance or commercially available fragrance was added was held in Glass Container 2, air was flowed through Glass Container 2 at 100 mL/min, and the emitted gas was collected in Adsorption Tube 1. Adsorption Tube 1 containing the collected gas was analyzed by thermal desorption GC/MS under the conditions described below.

Calibration curves were constructed as follows. A standard solution was prepared by placing 0.1152 g of a toluene standard in a 100 mL volumetric flask and filling up the flask to the mark with methanol. This solution was appropriately diluted to prepare three different levels of standard solutions. From each of the standard solutions, 1 μL was taken and introduced into an adsorption tube. The adsorption tube was analyzed by GC/MS under the following measurement conditions. A calibration curve was prepared by plotting the peak area of the GC/MS total ion chromatogram against the absolute quantities (μg) of the introduced component. The total emission was determined by obtaining the total peak area from the GC/MS total ion chromatogram of a sample and comparing the total peak area with the toluene calibration curves.

Thermal desorption device: JTD-505II (produced by Japan Analytical Industry Co., Ltd.)

First thermal desorption conditions: desorption temperature of 260° C., trap temperature of −60° C., time of 15 minutes Secondary thermal desorption conditions: 280° C. for 180 seconds GC device: HP5890 (produced by Hewlett Packard)

Column: DB-5MS (produced by J&W), 30 m×0.25 mm (ID), film thickness of 0.5 μm

Column temperature: 40° C. (4 min), 280° C. (heating rate: 6° C./min)

MS device: JMS-SX102A mass spectrometer (produced by JEOL Ltd.)

Ionization method: EI

Scan range: m/z 10 to 500 (1.2 sec/scan)

TIC mass range: m/z 29 to 500"

Evaluation Criteria

Products according to Examples and Comparative Examples that exhibited an odor intensity of 2.0 or more as determined by Sensory Analysis 1 at 48 hours after drying and a total fragrance component emission of 0.1 μg/g·h or more as measured at room temperature (23° C.±3° C.) were evaluated as "Good". Products that fail to meet these criteria were evaluated as "Poor". The results are shown in Tables 3 and 4.

Example 1

Tetramethylene ether diol having a molecular weight of 3500 and 4,4'-MDI were fed into a container at a diol:MDI molar ratio of 1:2.06. The mixture was reacted at 90° C. using triethylamine as a catalyst. The obtained reaction product was added to N,N-dimethylacetamide (DMAc) and the mixture was sufficiently stirred until the reaction product was dissolved to prepare a solution. To the solution in which the reactant was dissolved, a DMAc solution containing ethylenediamine (abbreviated to EDA) as a chain extender was added, and a DMAc solution containing diethylamine as an end-capping agent was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urea liquid PUU-A having a total solid content of 33% by weight was prepared. The obtained liquid had a viscosity of about 2800 poise at 40° C. The limiting viscosity of the polymer as measured in DMAc at a concentration of 0.5 g/100 mL at 25° C. was 0.98.

PUU-A was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments. The treatment agent applied by the oiling roller was an oil consisting of 96% by weight of a silicone oil and 4% by weight of magnesium stearate and having a viscosity of 10 centistokes at 25° C. The rotational speed of the oiling roller was adjusted so that the amount of the oil adhering to the fiber was 5% by weight based on the total weight of the fiber. The filaments were rolled up at a speed of 540 m/min. Thus, a polyurethane urea fiber PUU-1 being composed of the four filaments and having 33 dtex was produced. The total concentration of urethane and urea groups in the polyurethane urea constituting PUU-1 was 1.00 mol/kg and the concentration of effective terminal amines was 34 meq/kg. The high-temperature melting point of PUU-1 was 253° C.

PUU-1 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 4.0. The fragrance emission 1 measured after a lapse of 48 hours was 3.56 μg/g·h.

Example 2

Tetramethylene ether diol having a molecular weight of 1800 and 4,4'-MDI were fed into a container at a diol:MDI molar ratio of 1:1.70. The mixture was reacted at 90° C. The obtained reaction product was added to N,N-dimethylacetamide (DMAc) and the mixture was sufficiently stirred until the reaction product was dissolved to prepare a solution. To the solution in which the reactant was dissolved, a DMAc solution containing ethylenediamine (abbreviated to EDA) as a chain extender was added, and a DMAc solution containing diethylamine as an end-capping agent was added. To the resulting solution, an addition polymer of divinylbenzene and p-cresol ("Methacrol" (registered trademark)

2390 produced by DuPont) was added as a stabilizer in an amount of 1% based on the solid content of the solution. Thus, a polyurethane urea liquid PUU-B having a total solid content of 30% by weight was prepared. The obtained liquid had a viscosity of about 3000 poise at 40° C. The limiting viscosity of the polymer as measured in DMAc at a concentration of 0.5 g/100 mL at 25° C. was 1.05.

To PUU-B, a polyurethane produced by reaction of t-butyl diethanolamine and methylene-bis(4-cyclohexylisocyanate) ("Methacrol" (registered trademark) 2462 produced by DuPont) was added in an amount of 2% based on the solid content of PUU-B. The mixture was extruded from a spinneret under an inert gas (nitrogen gas) having a high temperature (350° C.) to form four filaments. The filaments were passed through the high temperature gas for drying and, before being completely dried, were led through an air jet twister so that a plurality of the filaments were twisted and coalesced. The coalesced filaments were guided via a godet roller to an oiling roller, where a treatment agent was applied to the filaments in the same manner as in Example 1. The filaments were rolled up at a speed of 540 m/min. Thus, four types of polyurethane urea fibers PUU-2 were produced: a polyurethane urea fiber PUU-2 being composed of coalesced four filaments and having 33 dtex, a polyurethane urea fiber PUU-2 being composed of coalesced four filaments and having 44 dtex, a polyurethane urea fiber PUU-2 being composed of coalesced four filaments and having 55 dtex, and a polyurethane urea fiber PUU-2 being composed of coalesced two filaments and having 22 dtex. The total concentration of urethane and urea groups in the polyurethane urea constituting PUU-2 was 1.51 mol/kg and the concentration of effective terminal amines was 19 meq/kg. The high-temperature melting point of PUU-2 was 280° C.

PUU-2 of 33 dtex alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 22.4 μg/g·h.

Example 3

In a reactor equipped with a stirrer were placed 87.5 mol of dehydrated tetrahydrofuran and 12.5 mol of dehydrated 3-methyl-tetrahydrofuran. Copolymerization reaction was performed under nitrogen seal in the presence of a catalyst (a mixture of 70% by weight of perchloric acid and 30% by weight of acetic anhydride) at 10° C. for 8 hours. After the reaction, the reaction product was neutralized with a sodium hydroxide aqueous solution to give tetramethylene ether diol having a number average molecular weight of 2000 (containing 12.5 mol % of the structural units (a) derived from 3-methyl-tetrahydrofuran). The copolymerized diol was used as a polyalkylene ether diol. The copolymerized tetramethylene ether diol and MDI were fed into a container at a diol:MDI molar ratio of 1:4.9. The mixture was reacted at 90° C. The obtained reaction product was thoroughly dissolved in N,N-dimethylacetamide (DMAc). To the solution in which the reactant was dissolved, a DMAc solution containing EDA as a chain extender was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urea liquid PUU-C having a total solid content of 32% by weight was prepared.

PUU-C was extruded from a spinneret under an inert gas (nitrogen gas) having a high temperature (350° C.) to form three filaments. The filaments were passed through the high temperature gas for drying and, before being completely dried, were led through an air jet twister so that the three filaments were twisted and coalesced. The coalesced filaments were guided via a godet roller to an oiling roller, where a treatment agent was applied to the filaments in the same manner as in Example 1. The filaments were rolled up at a speed of 500 m/min. Thus, a polyurethane urea fiber PUU-3 being composed of the coalesced three filaments and having 33 dtex was produced. The total concentration of urethane and urea groups in the polyurethane constituting PUU-3 was 3.00 mol/kg and the concentration of effective terminal amines was 32 meq/kg. The high-temperature melting point of PUU-3 was 266° C.

PUU-3 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 42.5 μg/g·h.

Example 4

In a reactor equipped with a stirrer were placed 85.5 mol of dehydrated tetrahydrofuran and 14.5 mol of dehydrated 3-methyl-tetrahydrofuran. Copolymerization reaction was performed under nitrogen seal in the presence of a catalyst (a mixture of 70% by weight of perchloric acid and 30% by weight of acetic anhydride) at 10° C. for 8 hours. After the reaction, the reaction product was neutralized with a sodium hydroxide aqueous solution to give tetramethylene ether diol having a number average molecular weight of 1000 (containing 14.5 mol % of the structural units (a) derived from 3-methyl-tetrahydrofuran). The copolymerized diol was used as a polyalkylene ether diol. The copolymerized tetramethylene ether diol and MDI were fed into a container at a diol:MDI molar ratio of 1:5.3. The mixture was reacted at 90° C. The obtained reaction product was thoroughly dissolved in N,N-dimethylacetamide (DMAc). To the solution in which the reactant was dissolved, a DMAc solution containing diethylamine and EDA as chain extenders was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urea liquid PUU-D having a total solid content of 32% by weight was prepared.

PUU-D was extruded from a spinneret under an inert gas (nitrogen gas) having a high temperature (350° C.) to form three filaments. The filaments were passed through the high temperature gas for drying and, before being completely dried, were led through an air jet twister so that the three filaments were twisted and coalesced. The coalesced filaments were guided via a godet roller to an oiling roller, where a treatment agent was applied to the filaments in the same manner as in Example 1. The filaments were rolled up at a speed of 500 m/min. Thus, a polyurethane urea fiber PUU-4 being composed of the coalesced three filaments and having 33 dtex was produced. The total concentration of urethane and urea groups in the polyurethane constituting PUU-4 was 4.50 mol/kg and the concentration of effective terminal amines was 21 meq/kg. The high-temperature melting point of PUU-4 was 288° C.

PUU-4 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 4.0. The fragrance emission 1 measured after a lapse of 48 hours was 2.6 μg/g·h.

Example 5

Tetramethylene ether diol having a molecular weight of 1800 and 4,4'-MDI were fed into a container at a diol:MDI molar ratio of 1:2.60. The mixture was reacted at 80° C. The obtained reaction product was added to N,N-dimethylacetamide (DMAc) and the mixture was sufficiently stirred until the reaction product was dissolved to prepare a solution. To the solution in which the reactant was dissolved, a DMAc solution containing ethylene glycol as a chain extender and acetic anhydride as a catalyst was added, and a DMAc solution containing butanol as an end-capping agent was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urethane liquid PU-E having a total solid content of 35% by weight was prepared. The obtained liquid had a viscosity of about 3500 poise at 40° C. The limiting viscosity of the polymer as measured in DMAc at a concentration of 0.5 g/100 mL at 25° C. was 1.10.

This polyurethane urethane liquid PU-E was extruded from a spinneret under an inert gas (nitrogen gas) having a high temperature (350° C.) to form two filaments. The filaments were passed through the high temperature gas for drying and, before being completely dried, were led through an air jet twister so that the two filaments were twisted and coalesced. The coalesced filaments were guided via a godet roller to an oiling roller, where a treatment agent was applied to the filaments in the same manner as in Example 1. The filaments were rolled up at a speed of 600 m/min. Thus, a polyurethane urethane fiber PU-5 being composed of the coalesced two filaments and having 33 dtex was produced. The total concentration of urethane and urea groups in the polyurethane urethane constituting PU-5 was 1.95 mol/kg. The high-temperature melting point of PU-5 was 220° C.

PU-5 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 10.2 μg/g·h.

Example 6

Tetramethylene ether diol having a molecular weight of 2000, a polyethylene glycol having a molecular weight of 2000 and 4,4'-MDI were fed into a container at a diol:glycol:MDI molar ratio of 0.5:0.5:5.30. The mixture was reacted at 80° C. The obtained reaction product was added to N,N-dimethylacetamide (DMAc) and the mixture was sufficiently stirred until the reaction product was dissolved to prepare a solution. To the solution in which the reactant was dissolved, a DMAc solution containing ethylene glycol as a chain extender and acetic anhydride as a catalyst was added, and a DMAc solution containing butanol as an end-capping agent was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urethane liquid PU-F having a total solid content of 35% by weight was prepared. The obtained liquid had a viscosity of about 3500 poise at 40° C. The limiting viscosity of the polymer as measured in DMAc at a concentration of 0.5 g/100 mL at 25° C. was 0.90.

This polyurethane urethane liquid PU-F was extruded from a spinneret under an inert gas (nitrogen gas) having a high temperature (350° C.) to form two filaments. The filaments were passed through the high temperature gas for drying and, before being completely dried, were led through an air jet twister so that the two filaments were twisted and coalesced. The coalesced filaments were guided via a godet roller to an oiling roller, where a treatment agent was applied to the filaments in the same manner as in Example 1. The filaments were rolled up at a speed of 600 m/min. Thus, a polyurethane urethane fiber PU-6 being composed of the coalesced two filaments and having 33 dtex was produced. The total concentration of urethane and urea groups in the polyurethane urethane constituting PU-6 was 3.95 mol/kg. The high-temperature melting point of PU-6 was 240° C.

PU-6 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 4.5. The fragrance emission 1 measured after a lapse of 48 hours was 8.28 μg/g·h.

Example 7

To PUU-A used in Example 1, a polyurethane produced by reaction of t-butyl diethanolamine and methylene-bis(4-cyclohexylisocyanate) ("Methacrol" (registered trademark)

2462 produced by DuPont) was added in an amount of 20% based on the solid content of PUU-A. The mixture was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments in the same manner as in Example 1. The filaments were rolled up at a speed of 540 m/min. Thus, a polyurethane urea fiber PUU-7 being composed of the coalesced four filaments and having 33 dtex was produced. The total concentration of urethane and urea groups in the polyurethane urea constituting PUU-7 was 1.82 mol/kg and the concentration of effective terminal amines was 24 meq/kg. The high-temperature melting point of PUU-7 was 246° C.

PUU-7 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 4.5. The fragrance emission 1 measured after a lapse of 48 hours was 10.3 μg/g·h.

Example 8

To PUU-B used in Example 2, a polyurethane produced by reaction of t-butyl diethanolamine and methylene-bis(4-cyclohexylisocyanate) ("Methacrol" (registered trademark) 2462 produced by DuPont) was added together with a polyurea produced by reaction of N-methyl-3,3'-iminobis (propylamine) and methylene-bis(4-cyclohexylisocyanate), each in an amount of 2% based on the solid content of PUU-B. The mixture was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments in the same manner as in Example 1. The filaments were rolled up at a speed of 540 m/min. Thus, a polyurethane urea fiber PUU-8 being composed of the coalesced four filaments and having 33 dtex was produced. The total concentration of urethane and urea groups in the polyurethane urea constituting PUU-8 was 1.52 mol/kg and the concentration of effective terminal amines was 19 meq/kg. The high-temperature melting point of PUU-8 was 285° C.

PUU-8 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 46.8 μg/g·h.

Example 9

To PUU-B used in Example 2, a polyurethane produced by reaction of t-butyl diethanolamine and methylene-bis(4-cyclohexylisocyanate) ("Methacrol" (registered trademark) 2462 produced by DuPont) was added together with cyclodextrin (Isoelite P produced by Ensuiko Sugar Refining Co., Ltd.), each in an amount of 2% based on the solid content of PUU-B. The mixture was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments in the same manner as in Example 1. The filaments were rolled up at a speed of 540 m/min. Thus, a polyurethane urea fiber PUU-9 being composed of the coalesced four filaments and having 33 dtex was produced. The total concentration of urethane and urea groups in the polyurethane urea constituting PUU-9 was 1.48 mol/kg and the concentration of effective terminal amines was 19 meq/kg. The high-temperature melting point of PUU-9 was 280° C.

PUU-9 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 39.2 μg/g·h.

Example 10

To PUU-B used in Example 2, a polyurethane produced by reaction of t-butyl diethanolamine and methylene-bis(4-cyclohexylisocyanate) ("Methacrol" (registered trademark) 2462 produced by DuPont) was added together with, as a metallic compound, a composite oxide $MgO.Al_2O_3$ produced by calcinating hydrotalcite (NAOX-19 produced by Toda Kogyo Corporation) at 900° C., each in an amount of 2% based on the solid content of PUU-B. The mixture was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments in the same manner as in Example 1. The filaments were rolled up at a speed of 540 m/min. Thus, a polyurethane urea fiber PUU-10 being composed of the coalesced four filaments and having 33 dtex was produced. The total concentration of urethane and urea groups in the polyurethane urea constituting PUU-10 was 1.48 mol/kg and the concentration of effective terminal amines was 19 meg/kg. The high-temperature melting point of PUU-10 was 280° C.

PUU-10 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 5.0. The fragrance emission 1 measured after a lapse of 48 hours was 44.9 μg/g·h.

Comparative Example 1

A polyethylene terephthalate yarn (E) (44 dtex, 36 fil) alone was fed to a single tubular knitting machine having 320 needles and a cylinder diameter of 3.5 inches (29 gauge) and knitted into a fabric and the fabric was steam-set at 120° C. for 1 minute to give a tubular knitted fabric pet-1 having a width of about 5 cm (55 g/m$^2$). The obtained fabric was used as a sample without cutting open (the fabric was equivalent to two plies of a knitted fabric of 55 g/m$^2$). The fragrance shown in Table 3 was added to the fabric, and the above Sensory Analyses 1 to 3 and the measurement of the total fragrance component emission were performed. The results are shown in Table 3.

Comparative Example 2

A wooly nylon yarn (N) (44 dtex, 34 fil) alone was fed to a single tubular knitting machine having 320 needles and a cylinder diameter of 3.5 inches (29 gauge) and knitted into a fabric and the fabric was steam-set at 120° C. for 1 minute to give a tubular knitted fabric ny-2 having a width of about 5 cm (55 g/m$^2$). The obtained fabric was used as a sample without cutting open (the fabric was equivalent to two plies of a knitted fabric of 55 g/m$^2$). The fragrance shown in Table 3 was added to the fabric, and the above Sensory Analyses 1 to 3 and the measurement of the total fragrance component emission were performed. The results are shown in Table 3.

Comparative Example 3

Raw cotton fiber (Indian cotton) was scoured, fed into a ring spinning frame (produced by Toyota Industries Corporation), and spun into a spun yarn having a cotton count of 30 (English cotton count). The produced spun yarn was formed into a circular knitted fabric (using a knitting machine with 38 inch cylinder diameter, 24 gauge, and 114 feeders), and the fabric was steam-set at 120° C. for 1 minute to give a fabric co-3. The fragrance shown in Table 3 was added to the fabric, and the above Sensory Analyses 1 to 3 and the measurement of the total fragrance component emission were performed. The results are shown in Table 3.

Comparative Example 4

Tetramethylene ether diol having a molecular weight of 3500 and 4,4'-MDI were fed into a container at a diol:MDI molar ratio of 1:1.05. The mixture was reacted at 90° C. using triethylamine as a catalyst. The obtained reaction product was added to N,N-dimethylacetamide (DMAc) and the mixture was sufficiently stirred until the reaction product was dissolved to prepare a solution. To the solution in which the reactant was dissolved, a DMAc solution containing ethylenediamine (abbreviated to EDA) as a chain extender was added, and a DMAc solution containing diethylamine as an end-capping agent was added. To the resulting solution, an addition polymer of divinylbenzene and p-cresol ("Methacrol" (registered trademark) 2390 produced by DuPont) was added as a stabilizer in an amount of 1% based on the solid content of the solution. Thus, a polyurethane urea liquid puu-g having a total solid content of 33% by weight was prepared. The obtained liquid had a viscosity of about 2800 poise at 40° C. The limiting viscosity of the polymer as measured in DMAc at a concentration of 0.5 g/100 mL at 25° C. was 0.98.

puu-g was extruded from a spinneret under an inert gas (nitrogen gas) having a high temperature (350° C.) to form four filaments. The filaments were passed through the high temperature gas for drying and, before being completely dried, were led through an air jet twister so that the four filaments were twisted and coalesced. The coalesced filaments were guided via a godet roller to an oiling roller, where a treatment agent was applied to the filaments. The treatment agent applied by the oiling roller was an oil consisting of 96% by weight of a silicone oil and 4% by weight of magnesium stearate and having a viscosity of 10 centistokes at 25° C. The rotational speed of the oiling roller was adjusted so that the amount of the oil adhering to the fiber was 5% by weight based on the total weight of the fiber. The filaments were rolled up at a speed of 540 m/min. Thus, a polyurethane urea fiber puu-4 being composed of the coalesced two filaments and having 33 dtex was produced. The total concentration of urethane and urea groups in the polyurethane urea constituting puu-4 was 0.50 mol/kg and the concentration of effective terminal amines was 34 meq/kg. The high-temperature melting point of puu-4 was 253° C.

puu-4 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 1.5. The fragrance emission 1 measured after a lapse of 48 hours was 0.0488 μg/g·h.

Comparative Example 5

Into a twin screw extruder with an L/D ratio of 40, PTMG having a molecular weight of 2000, 4,4'-MDI, and 1,4-butanediol as a chain extender were continuously fed under nitrogen seal at a PTMG:MDI molar ratio of 1:7.50 and were allowed to react by the one-shot method at a reaction temperature of 240° C. The generated polyurethane was extruded in a form of strands with a diameter of about 3 mm. The strands were cooled with water and cut into pellets. The weight average molecular weight of the obtained polyurethane (pu-h) was 170,000 as expressed in terms of polystyrene equivalents, and the melt viscosity measured at a shear rate of 1000 sec$^{-1}$ at 220° C. was 200 poise.

The pellets were predried in a batch-type vacuum dryer at 80° C. for 12 hours. After drying, the pellets were melted in a single screw extruder, metered by a gear pump, extruded from a die, and passed through a quenching column into which cooling air was flowed. With a setting of the speed ratio of a godet roller to a winder of 1.4, the filaments were guided via the godet roller to an oiling roller, where a treatment agent was applied to the filaments in the same manner as in Comparative Example 1. Two filaments melt-spun at a speed of 220 m/min were coalesced into a yarn of 33 dtex, rolled up, and heat-aged at 80° C. for 24 hours to give a polyurethane urethane fiber (pu-5). The total concentration of urethane and urea groups in the polyurethane constituting pu-5 was 5.50 mol/kg. The properties of the obtained yarn are shown in Table 2. The high-temperature melting point of pu-5 was 245° C.

pu-5 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 2.0. The fragrance emission 1 measured after a lapse of 48 hours was 0.0673 μg/g·h.

Comparative Example 6

Into a twin screw extruder with an L/D ratio of 40, PTMG having a molecular weight of 2000, 4,4'-MDI, and 1,4-butanediol as a chain extender were continuously fed under nitrogen seal at a PTMG:MDI molar ratio of 1:9.50 and were allowed to react by the one-shot method at a reaction temperature of 240° C. The generated polyurethane (pu-i) was extruded in a form of strands with a diameter of about 3 mm. The strands were cooled with water and cut into pellets. The melt viscosity measured at a shear rate of 1000 sec$^{-1}$ at 220° C. was 350 poise.

The pellets were predried in a batch-type vacuum dryer at 80° C. for 12 hours. After drying, the pellets were melted in a single screw extruder, metered by a gear pump, extruded from a die, and passed through a quenching column into which cooling air was flowed. With a setting of the speed ratio of a godet roller to a winder of 1.1, the filaments were guided via the godet roller to an oiling roller, where a treatment agent was applied to the filaments in the same manner as in Example 1. Two filaments melt-spun at a speed of 110 m/min were coalesced into a yarn of 33 dtex, rolled up, and heat-aged at 80° C. for 24 hours to give a polyurethane urethane fiber (pu-6). The total concentration of urethane and urea groups in the polyurethane constituting pu-6 was 7.00 mol/kg. The properties of the obtained yarn are shown in Table 2. The high-temperature melting point of pu-6 was 255° C.

pu-6 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 1.5. The fragrance emission 1 measured after a lapse of 48 hours was 0.0189 μg/g·h.

Comparative Example 7

A fabric was produced from the polyurethane urea fiber (PUU-1) in the same manner as in Example 1 except that the type of oil was changed. The oil used was an oil consisting of 92% by weight of a mineral oil and 8% by weight of limonene and having a viscosity at 25° C. of 10 centistokes.

The odor intensity measured after a lapse of 48 hours was 5.0. The fragrance emission 1 measured after a lapse of 48 hours was 4.63 μg/g·h. However, the fabric showed a score of −3.0 in the fragrance-retaining test 2, Nine-grade Pleasant and Annoying Odor Measurement, and emitted a very annoying odor similar to that of overripe citrus fruit.

Comparative Example 8

A fabric was produced from the polyurethane urea fiber (PUU-1) in the same manner as in Example 1 except that the type of oil was changed. The oil used was an oil consisting of 98% by weight of a mineral oil and 2% by weight of hinokitiol and having a viscosity at 25° C. of 10 centistokes.

The odor intensity measured after a lapse of 48 hours was 4.0. However, the fabric showed a score of −4.0 in the fragrance-retaining test 2, Nine-grade Pleasant and Annoying Odor Measurement, and emitted an extremely annoying odor resulting from severe deterioration in the scent balance caused by combination with the commercially available fragrance.

Comparative Example 9

"Pebax" 4033 (melting point: 160° C., produced by ARKEMA S.A.) pellets were predried in a batch-type vacuum dryer at 80° C. for 12 hours. After drying, the pellets were melted in a single screw extruder, metered by a gear pump, extruded from a die, and passed through a quenching column into which cooling air was flowed. With a setting of the speed ratio of a godet roller to a winder of 2.00, the filaments were guided via the godet roller to an oiling roller, where a treatment agent was applied to the filaments in the same manner as in Example 1. Two filaments melt-spun at a speed of 110 m/min were coalesced into a yarn of 33 dtex, rolled up, and heat-aged at 80° C. for 24 hours to give pae-9. The properties of the obtained yarn are shown in Table 2. The high-temperature melting point of pae-9 was 165° C.

pae-9 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 2.0. The fragrance emission 1 measured after a lapse of 48 hours was 0.0222 μg/g·h.

Comparative Example 10

"Pellethane" 2102-90A (melting point: 214° C., produced by Dow Chemical Company) pellets were predried in a batch-type vacuum dryer at 80° C. for 12 hours. After drying, the pellets were melted in a single screw extruder, metered by a gear pump, extruded from a die, and passed through a quenching column into which cooling air was flowed. With a setting of the speed ratio, of a godet roller to a winder of 1.30, the filaments were guided via the godet roller to an oiling roller, where a treatment agent was applied to the filaments in the same manner as in Example 1. Two filaments melt-spun at a speed of 110 m/min were coalesced into a yarn of 33 dtex, rolled up, and heat-aged at 80° C. for 24 hours to give pu-10. The properties of the obtained yarn are shown in Table 2. The high-temperature melting point of pu-10 was 220° C.

pu-10 alone was fed to a single tubular knitting machine having 320 needles and a cylinder diameter of 3.5 inches (29 gauge) and knitted into a fabric and the fabric was steam-set at 120° C. for 1 minute to give a tubular knitted fabric having a width of about 5 cm (38 g/m$^2$). The obtained fabric was used as a sample without cutting open (the fabric was equivalent to two plies of a knitted fabric of 38 g/m$^2$). The fragrance shown in Table 3 was added to the fabric, and the above Sensory Analyses 1 to 3 and the measurement of the total fragrance component emission were performed. The results are shown in Table 3. The odor intensity measured after a lapse of 48 hours was 2.5. The fragrance emission 1 measured after a lapse of 48 hours was 0.0619 μg/g·h.

Examples 11 to 18

Fabrics were produced using the polyurethane fiber PUU-2 in accordance with the combinations and amounts of fibers shown in Table 4. Fabric A was produced by Fabric Making Process-L in Table 1, Fabric B was produced by Fabric Making Process-L2 in Table 1, Fabrics C and D were produced by Fabric Making Process-M in Table 1, Fabric E was produced by Fabric Making Process-M2 in Table 1, and Fabric F was produced by Fabric Making Process-N in Table 1. The fragrances shown in Table 4 were added to the produced fabrics, and the above Sensory Analysis 1 and the measurement of the total fragrance component emission were performed. The results are shown in Table 4.

Comparative Examples 11 to 18

Fabrics were produced using the polyurethane fibers puu-4, pu-5 or pu-6 in accordance with the combinations and amounts of fibers shown in Table 4. Fabric x was produced by Fabric Making Process-o in Table 2, Fabric y was produced by Fabric Making Process-p in Table 2, and Fabrics a13 to a15 were produced by Fabric Making Process-t in Table 2. The fragrances shown in Table 4 were added to the produced fabrics, and the above Sensory Analysis 1 and the measurement of the total fragrance component emission were performed. The results are shown in Table 4.

Example 19

Figure 2:
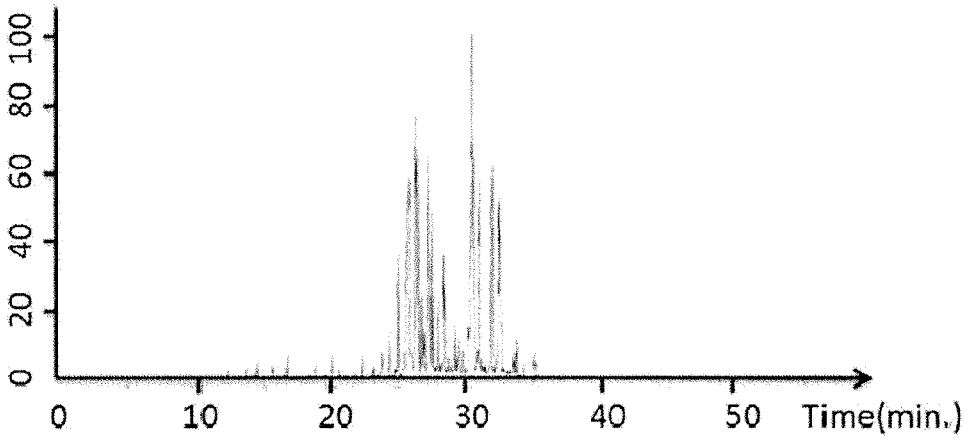
FIG. 2 is a GC/MS total ion chromatogram in Example 19.

FIG. 2 shows the peak chart from the GC/MS total ion chromatography performed during the measurement of the total emission of the fragrance from the fabric used in Example 17 to which the fragrance was added under the conditions as in Example 17. A 2.4±0.1 g sample was taken from the fabric immediately after the drying and subjected to the measurement. The temperature at the time of flowing air to the glass tube and collecting the emitted gas was 40° C., and the duration of collecting the gas was 24 hours (0 hour to 24 hour after the drying).

Example 20

Figure 3:
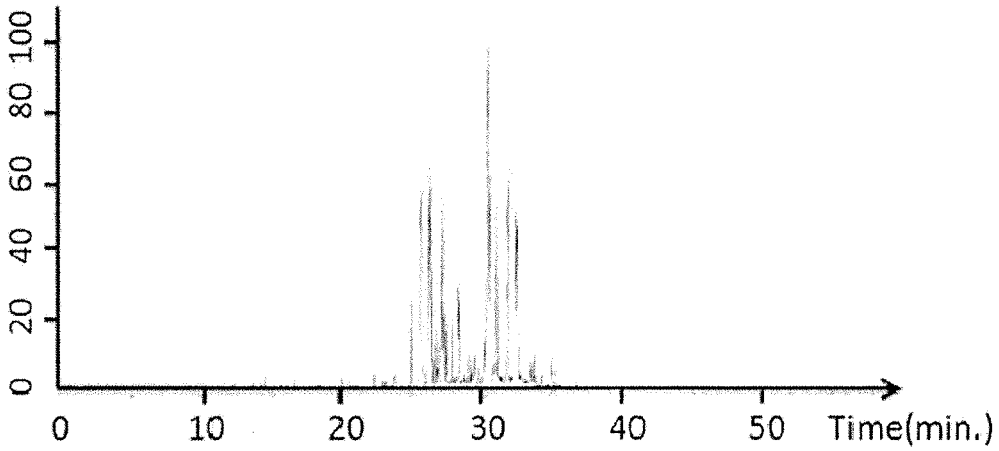
FIG. 3 is a GC/MS total ion chromatogram in Example 20.

Immediately after the collection in the adsorption tube in Example 19, the tube was replaced with another adsorption tube (the same sample having the added fragrance was used continuously), and the emitted gas was collected in the same manner as above for 24 hours (24 hour to 48 hour after the drying). A peak chart was obtained from GC/MS total ion chromatography as in Example 19. The results are shown in FIG. 3.

Comparative Example 19

Figure 4:
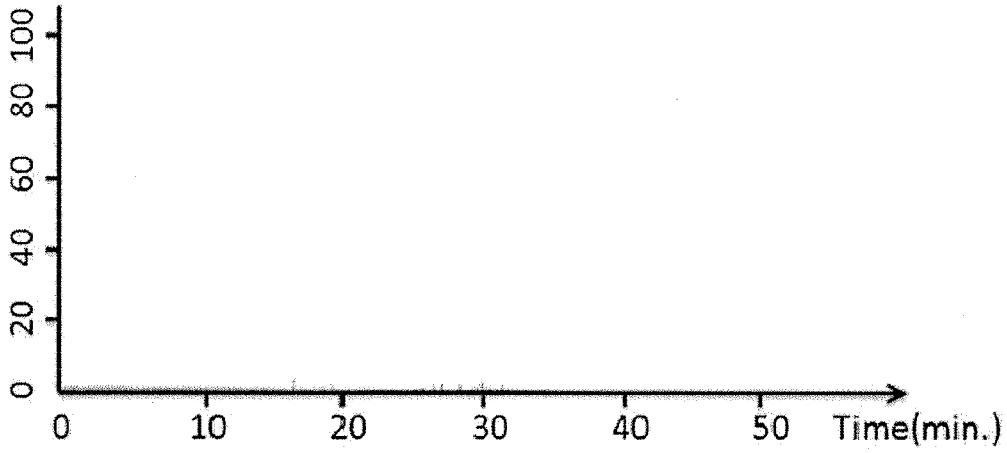
FIG. 4 is a GC/MS total ion chromatogram in Comparative Example 19.
Figure 5:
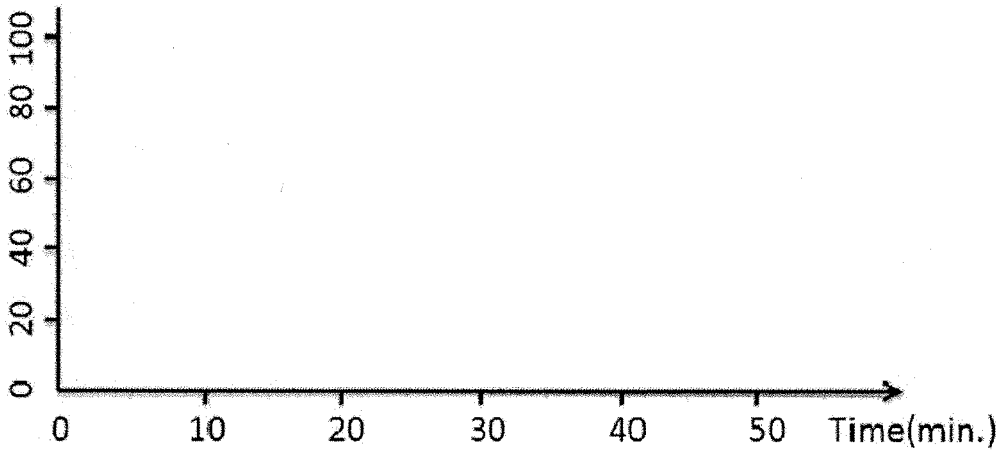
FIG. 5 is a GC/MS total ion chromatogram in Comparative Example 20.

FIG. 4 shows the peak chart from the GC/MS total ion chromatography performed during the measurement of the total emission of the fragrance from the fabric used in Comparative Example 17 to which the fragrance was added under the conditions as in Comparative Example 17. A 2.4±0.1 g sample was taken from the fabric immediately after the drying and subjected to the measurement. The temperature at the time of flowing air to the glass tube and collecting the emitted gas was 40° C., and the duration of collecting the gas was 24 hours (0 hour to 24 hour after the drying).

Comparative Example 20

Immediately after the collection in the adsorption tube in Comparative Example 19, the tube was replaced with another adsorption tube (the same sample having the added fragrance was used continuously), and the emitted gas was collected in the same manner as above for 24 hours (24 hour to 48 hour after the drying). A peak chart was obtained from GC/MS total ion chromatography in the same manner as in Example 19. The results are shown in Table 5.

In FIGS. 2 to 5, the horizontal axis indicates the detection time (minutes) (range: 0 to 55 minutes). The vertical axis indicates the detected signal intensity. The detected signal intensity is indicated in the range from 0 to 100 in FIGS. 2 to 5. FIGS. 2 and 3 show strong peaks clearly indicating the detection of signal intensity, whereas FIGS. 4 and 5 do not show any peak clearly indicating the detection of signal intensity. That is, when Example 19 (FIG. 2) and Comparative Example 19 (FIG. 4), the difference between which is the type of fabric, are compared, it is evident that the emission of the fragrance component during 24 hours from 0 to 24 hour after the drying is significantly larger in Example 19 than in Comparative Example 19. As with the above, when Example 20 (FIG. 3) is compared with Comparative Example 20 (FIG. 5), it is evident that the emission of the fragrance component during 24 hours from 24 to 48 hour after the drying is significantly larger in Example 20 than in Comparative Example 20.

TABLE 1

| | Fabric Making Process-L | Fabric Making Process-L2 | Fabric Making Process-M | Fabric Making Process-M2 | Fabric Making Process-N |
|---|---|---|---|---|---|
| Knitting | Rayon staple fibers (single fiber fineness: 1.1 dtex, fiber length: 51 mm) obtained by the viscose process were blended with Indian cotton at a ratio of 40 wt % of rayon to 60 wt % of cotton. The mixture was spun into a spun yarn having a cotton count of 50 by usual spinning process. The spun yarn having a cotton count of 50 was knitted together with polyester filaments of 56 dtex-24 filaments (produced by Toray Industries, Inc.) and with a polyurethane elastic fiber of 44 dtex using a single circular knitting machine of 28 gauge to give a bare-fiber jersey-stitch knitted fabric. | Rayon staple fibers (single fiber fineness: 1.1 dtex, fiber length: 51 mm) obtained by the viscose process were blended with Indian cotton at a ratio of 40 wt % of rayon to 60 wt % of cotton. The mixture was spun into a spun yarn having a cotton count of 50 by usual spinning process. The spun yarn having a cotton count of 50 was knitted together with polyester filaments of 56 dtex-24 filaments (produced by Toray Industries, Inc.) and with a polyurethane elastic fiber of 22 dtex using a single circular knitting machine of 28 gauge to give a bare-fiber jersey-stitch knitted fabric. | Polyester filaments of 167 dtex-48 filaments (produced by Toray Industries, Inc.) were knitted together with a polyurethane elastic fiber of 22 dtex using a single circular knitting machine of 28 gauge to give a bare-fiber jersey-stitch knitted fabric. | Polyester filaments of 84 dtex-72filaments (produced by Toray Industries, Inc.) were knitted together with a polyurethane elastic fiber of 33 dtex using a single circular knitting machine of 28 gauge to give a bare-fiber jersey-stitch knitted fabric. | Nylon filaments of 44 dtex-34 filaments (produced by Toray Industries, Inc.) were knitted together with a polyurethane elastic fiber of 55 dtex using a single tricot knitting machine of 32 gauge to give a half tricot-stitch knitted fabric. |
| Dyeing | Dyeing was performed in accordance with usual dyeing process. The circular knitted fabric was pre-set with dry heat of 180° C. and scoured. The polyester was dyed with a disperse dye. The rayon and cotton were dyed with a reactive dye. The fabric was final-set with dry heat of 160° C. Thus, a knitted fabric with a mass per unit area of 205 g/m$^2$ was produced. | Dyeing was performed in accordance with usual dyeing process. The circular knitted fabric was pre-set with dry heat of 180° C. and scoured. The polyester was dyed with a disperse dye. The rayon and cotton were dyed with a reactive dye. The fabric was final-set with dry heat of 160° C. Thus, a knitted fabric with a mass per unit area of 205 g/m$^2$ was produced. | Dyeing was performed in accordance with usual dyeing process. The circular knitted fabric was pre-set with dry heat of 180° C. and scoured. The polyester was dyed with a disperse dye. The fabric was final-set with dry heat of 160° C. Thus, a knitted fabric with a mass per unit area of 175 g/m$^2$ was produced. | Dyeing was performed in accordance with usual dyeing process. The circular knitted fabric was pre-set with dry heat of 180° C. and scoured. The polyester was dyed with a disperse dye. The fabric was final-set with dry heat of 160° C. Thus, a knitted fabric with a mass per unit area of 175 g/m$^2$ was produced. | Dyeing was performed in accordance with usual dyeing process. The blood knitted fabric was pre-set with dry heat of 180° C. and scoured. The nylon was dyed with an acid dye. The fabric was final-set with dry heat of 160° C. Thus, a knitted fabric with a mass per unit area of 200 g/m$^2$ was produced. |

TABLE 2

| | Fabric Making Process-o | Fabric Making Process-p | Fabric Making Process-r | Fabric Making Process-s | Fabric Making Process-t |
|---|---|---|---|---|---|
| Knitting | 100% Indian cotton was spun into a spun yarn having a cotton count of 50 by usual spinning process. The spun yarn was knitted into a jersey-stitch knitted fabric using a single circular knitting machine of 28 gauge. | 22% by weight of raw polyester (produced by Toray Industries, Inc.) (single fiber fineness: 1.7 dtex, fiber length: 38 mm) and 78% of Indian cotton were spun together into a spun yarn having a cotton count of 50 by usual spinning process. The spun yarn was knitted into a jersey-stitch knitted fabric using a single circular knitting machine of 28 gauge. | 78% by weight of raw polyester (produced by Toray Industries, Inc.) (single fiber fineness: 1.7 dtex, fiber length: 38 mm) and 22% of Indian cotton were spun together into a spun yarn having a cotton count of 50 by usual spinning process. The spun yarn was knitted into a jersey-stitch knitted fabric using a single circular knitting machine of 28 gauge. | Nylon filaments of 78 dtex-52 filaments (produced by Toray Industries, Inc.) were knitted into a jersey-stitch knitted fabric using a single circular knitting machine of 28 gauge. | Rayon staple fibers (single fiber fineness: 1.1 dtex, fiber length: 51 mm) obtained by the viscose process were blended with Indian cotton at a ratio of 40 wt % of rayon to 60 wt % of cotton. The mixture was spun into a spun yarn having a cotton count of 50 by usual spinning process. The spun yarn having a cotton count of 50 was knitted together with polyester filaments of 56 dtex-24 filaments (produced by Toray Industries, Inc.) and with a polyurethane elastic fiber of 44 dtex using a single |

TABLE 2-continued

| | Fabric Making Process-o | Fabric Making Process-p | Fabric Making Process-r | Fabric Making Process-s | Fabric Making Process-t |
|---|---|---|---|---|---|
| | | | | | circular knitting machine of 28 gauge to give a bare-fiber jersey-stitch knitted fabric. |
| Dyeing | Dyeing was performed in accordance with usual dyeing process. The circular knitted fabric was pre-set with dry heat of 180° C. and was scoured and bleached. The fabric was dyed with a reactive dye. The fabric was final-set with dry heat of 160° C. Thus, a knitted fabric with a mass per unit area of 210 g/m$^2$ was produced. | Dyeing was performed in accordance with usual dyeing process. The circular knitted fabric was pre-set with dry heat of 180° C. and was scoured and bleached. The polyester was dyed with a disperse dye. The cotton was dyed with a reactive dye. The fabric was final-set with dry heat of 160° C. Thus, a knitted fabric with a mass per unit area of 190 g/m$^2$ was produced. | Dyeing was performed in accordance with usual dyeing process. The circular knitted fabric was pre-set with dry heat of 180° C. and was scoured and bleached. The polyester was dyed with a disperse dye. The cotton was dyed with a reactive dye. The fabric was final-set with dry heat of 160° C. Thus, a knitted fabric with a mass per unit area of 190 g/m$^2$ was produced. | Dyeing was performed in accordance with usual dyeing process. The circular knitted fabric was pre-set with dry heat of 180° C. and scoured. The nylon was dyed with an acid dye. The fabric was final-set with dry heat of 160° C. Thus, a knitted fabric with a mass per unit area of 145 g/m$^2$ was produced. | Dyeing was performed in accordance with usual dyeing process. The circular knitted fabric was pre-set with dry heat of 180° C. and scoured. The polyester was dyed with a disperse dye. The rayon and cotton were dyed with a reactive dye. The fabric was final-set with dry heat of 160° C. Thus, a knitted fabric with a mass per unit area of 205 g/m$^2$ was produced. |

TABLE 3

| | Fiber | Polymer | Total concentration of urethane and urea groups (mol/kg) | Fragrance | Sensory Analysis 1 (Six-grade Odor Intensity Measurement) 24 h after drying | 48 h after drying | 72 h after drying |
|---|---|---|---|---|---|---|---|
| Example 1 | PUU-1 | PUU-A | 1.00 | Model fragrance | 4.5 | 4.0 | 3.5 |
| Example 2 | PUU-2 | PUU-B | 1.51 | Model fragrance | 5.0 | 5.0 | 5.0 |
| Example 3 | PUU-3 | PUU-C | 3.00 | Model fragrance | 5.0 | 5.0 | 5.0 |
| Example 4 | PUU-4 | PUU-D | 4.50 | Model fragrance | 5.0 | 4.0 | 3.5 |
| Example 5 | PU-5 | PU-E | 1.95 | Model fragrance | 5.0 | 5.0 | 4.5 |
| Example 6 | PU-6 | PU-F | 3.95 | Model fragrance | 5.0 | 4.5 | 4.0 |
| Example 7 | PUU-7 | PUU-A | 1.82 | Model fragrance | 4.5 | 4.5 | 4.5 |
| Example 8 | PUU-8 | PUU-B | 1.53 | Model fragrance | 5.0 | 5.0 | 5.0 |
| Example 9 | PUU-9 | PUU-B | 1.48 | Commercially available fragrance | 5.0 | 5.0 | 5.0 |
| Example 10 | PUU-10 | PUU-B | 1.48 | Commercially available fragrance | 5.0 | 5.0 | 5.0 |
| Comparative Example 1 | pet-1 | — | — | Model fragrance | 2.0 | 1.5 | 1.0 |
| Comparative Example 2 | ny-2 | — | — | Model fragrance | 2.0 | 1.0 | 1.0 |
| Comparative Example 3 | co-3 | — | — | Model fragrance | 2.0 | 1.0 | 1.0 |
| Comparative Example 4 | puu-4 | puu-g | 0.50 | Model fragrance | 3.5 | 1.5 | 1.0 |
| Comparative Example 5 | pu-5 | pu-h | 5.50 | Model fragrance | 4.0 | 2.0 | 1.5 |
| Comparative Example 6 | pu-6 | pu-i | 7.00 | Model fragrance | 2.5 | 1.5 | 1.0 |
| Comparative Example 9 | pae-9 | "Pebax" 4033 | — | Model fragrance | 2.0 | 1.0 | 1.0 |
| Comparative Example 10 | pu-10 | "Pellethane" 2102 | — | Model fragrance | 2.5 | 1.5 | 1.0 |

| | Sensory Analysis 2 (Nine-grade Pleasant and Annoying Odor Measurement) 48 h after drying | Sensory Analysis 3 (Functional Retention and Durability Test) 48 h after drying | Total emission of fragrance component μg/g · h, 23° C. 48 h after drying | μg/g · h, 40° C. 48 h after drying | Evaluation results |
|---|---|---|---|---|---|
| Example 1 | 3.5 | 3.0 | 3.5600 | 6.2500 | Good |
| Example 2 | 4.0 | 4.0 | 22.4000 | 55.1000 | Good |
| Example 3 | 4.0 | 4.0 | 42.5000 | 102.0000 | Good |
| Example 4 | 4.0 | 4.0 | 2.6000 | 5.3900 | Good |
| Example 5 | 4.0 | 4.0 | 10.2000 | 18.9000 | Good |
| Example 6 | 4.0 | 4.0 | 8.2800 | 13.0400 | Good |
| Example 7 | 3.5 | 4.0 | 10.3000 | 34.6000 | Good |
| Example 8 | 4.0 | 4.0 | 46.8000 | 73.5000 | Good |
| Example 9 | 4.0 | 4.0 | 39.2000 | 51.9000 | Good |
| Example 10 | 4.0 | 4.0 | 44.9000 | 127.0000 | Good |
| Comparative Example 1 | 1.0 | 1.0 | 0.0229 | 0.0344 | Poor |
| Comparative Example 2 | −0.5 | 0.5 | 0.0122 | 0.0211 | Poor |

TABLE 3-continued

| | | | | | |
|---|---|---|---|---|---|
| Comparative Example 3 | −0.5 | −0.5 | 0.0024 | 0.0486 | Poor |
| Comparative Example 4 | 1.5 | 1.5 | 0.0488 | 0.0123 | Poor |
| Comparative Example 5 | 2.0 | −1.0 | 0.0673 | 0.1080 | Poor |
| Comparative Example 6 | 1.5 | −1.0 | 0.0189 | 0.0083 | Poor |
| Comparative Example 9 | 1.0 | 0.0 | 0.0222 | 0.0397 | Poor |
| Comparative Example 10 | 2.0 | 0.0 | 0.0619 | 0.1740 | Poor |

TABLE 4

| | Fabric | Polyurethane fiber content % by mass | Polyester fiber content % by mass | Other fiber content % by mass | Polyurethane fiber | Total concentration of urethane and urea groups mol/kg | Fragrance |
|---|---|---|---|---|---|---|---|
| Example 11 | A | 12 | 32 | 56 | PUU-2 | 1.51 | Model fragrance |
| Example 12 | B | 6 | 34 | 60 | PUU-2 | 1.51 | Model fragrance |
| Example 13 | C | 2 | 98 | 0 | PUU-2 | 1.51 | Model fragrance |
| Example 14 | D | 4 | 96 | 0 | PUU-2 | 1.51 | Model fragrance |
| Example 15 | E | 18 | 82 | 0 | PUU-2 | 1.51 | Model fragrance |
| Example 16 | F | 36 | 0 | 64 | PUU-2 | 1.51 | Model fragrance |
| Example 17 | A | 12 | 32 | 56 | PUU-2 | 1.51 | Commercially available fragrance |
| Example 18 | B | 6 | 34 | 60 | PUU-2 | 1.51 | Commercially available fragrance |
| Comparative Example 11 | x | 0 | 0 | 100 | — | — | Model fragrance |
| Comparative Example 12 | y | 0 | 22 | 78 | — | — | Model fragrance |
| Comparative Example 13 | a13 | 12 | 32 | 56 | puu-4 | 0.50 | Model fragrance |
| Comparative Example 14 | a14 | 12 | 32 | 56 | pu-5 | 5.50 | Model fragrance |
| Comparative Example 15 | a15 | 12 | 32 | 56 | pu-6 | 7.00 | Model fragrance |
| Comparative Example 16 | a13 | 12 | 32 | 56 | puu-4 | 0.50 | Commercially available fragrance |
| Comparative Example 17 | x | 0 | 0 | 100 | — | — | Commercially available fragrance |
| Comparative Example 18 | y | 0 | 22 | 78 | — | — | Commercially available fragrance |

| | Sensory Analysis 1 (Six-grade Odor Intensity Measurement) | | | Total emission of fragrance component μg/g · h, 23° C. | μg/g · h, 40° C. | |
|---|---|---|---|---|---|---|
| | 24 h after drying | 48 h after drying | 72 h after drying | 48 h after drying | 48 h after drying | Evaluation results |
| Example 11 | 4.0 | 3.5 | 3.5 | 6.3700 | 14.6000 | Good |
| Example 12 | 3.0 | 3.0 | 3.0 | 1.2100 | 1.5400 | Good |
| Example 13 | 3.0 | 2.5 | 1.5 | 0.2550 | 0.6470 | Good |
| Example 14 | 3.0 | 2.5 | 2.0 | 0.6340 | 0.9990 | Good |
| Example 15 | 4.0 | 4.0 | 3.5 | 7.7500 | 23.4000 | Good |
| Example 16 | 4.0 | 4.0 | 4.0 | 10.5000 | 28.1000 | Good |
| Example 17 | 3.5 | 3.5 | 3.5 | 1.3300 | 3.3300 | Good |
| Example 18 | 3.5 | 3.5 | 3.0 | 0.8810 | 1.7900 | Good |
| Comparative Example 11 | 1.5 | 1.0 | 0.5 | 0.0004 | 0.0037 | Poor |
| Comparative Example 12 | 2.0 | 1.5 | 1.0 | 0.0023 | 0.0375 | Poor |
| Comparative Example 13 | 3.0 | 1.5 | 1.0 | 0.0039 | 0.0318 | Poor |
| Comparative Example 14 | 3.0 | 2.0 | 1.0 | 0.0055 | 0.0166 | Poor |
| Comparative Example 15 | 2.0 | 1.5 | 0.5 | 0.0069 | 0.0025 | Poor |
| Comparative Example 16 | 3.0 | 1.5 | 1.5 | 0.0096 | 0.0197 | Poor |
| Comparative Example 17 | 2.0 | 1.0 | 0.5 | 0.0019 | 0.0298 | Poor |
| Comparative Example 18 | 3.0 | 1.5 | 1.0 | 0.0085 | 0.0485 | Poor |

INDUSTRIAL APPLICABILITY

The polyurethane-based fiber of the present invention has an excellent fragrance-retaining property and excellent mechanical properties, and consequently clothes, materials, etc. using this fiber will have an excellent fragrance-retaining property. Due to such excellent properties of the polyurethane-based fiber of the present invention, the polyurethane-based fiber can be used alone or in combination with various types of other fibers or nonwoven fabrics to produce a fabric having an excellent fragrance-retaining property. The polyurethane-based fiber is suitable for knitting, weaving, braiding, and hot melt adhesive processing. In particular, the polyurethane-based fiber can be used for, for example, various types of textiles, such as underwear and bedclothes, as well as socks, pantyhose, tights, swimwear, skiwear, golf wear, shirts, suits, wet suits, brassieres, girdles, working wear, fire protective clothing, gloves, supporters, sweaters, round knitted fabrics, tricot knitted fabrics, and woven fabrics; fiber structures such as fragrance-absorbing fiber structures, fiber structures for use with fragrances, i.e., for use in aromatherapy etc., and various types of fiber structures for interior use; strapping materials; etc. Furthermore, the polyurethane-based fiber can be used to produce an elastic sheet that can be elongated by low stress, and is thus suitable for sanitary goods such as paper diapers and sanitary napkins, and their gathers for preventing leakage; as well as various types of filters, in particular filters for air conditioners and air cleaners; artificial flowers; wiping cloths; copier cleaners; gaskets; goods for companion animals; electric insulation materials; fabrics to be used as a wallpaper; etc.

REFERENCE SIGNS LIST

1 Adsorption Tube
2 Glass Container (Impinger)
3 Sample

The invention claimed is:

1. A method for retaining fragrance on a fragrance-retaining polyurethane-based fiber, the method comprising a step of allowing the fragrance-retaining polyurethane-based fiber to absorb a fragrance component by laundering, wherein the fragrance-retaining polyurethane-based fiber has a total concentration of urethane and urea groups of from 1.48 mol/kg to 3.00 mol/kg, wherein the fragrance-retaining polyurethane-based fiber has a single fiber fineness of from 3 dtex to 8.25 dtex, and wherein 48 hours after absorbing the fragrance component, a total emission of the fragrance component is from 0.1 μg/g·h to 1000 μg/g·h.

2. A method for retaining fragrance on a fragrance-retaining polyurethane-based fiber, the method comprising a step of allowing at least one of a fabric softener for laundry use and/or a laundry detergent to absorb a fragrance-component, and laundering the fragrance-retaining polyurethane-based fiber with the fabric softener and/or laundry detergent, wherein the fabric softener and/or laundry detergent contains only a nonionic surfactant having an HLB of from 10 to 17 as a surfactant, and wherein the fragrance-retaining polyurethane-based fiber has a total concentration of urethane and urea groups of from 1.48 mol/kg to 3.00 mol/kg, and a single fiber fineness of from 3 dtex to 8.25 dtex.

* * * * *